United States Patent [19]

McCoy, Jr. et al.

[11] 4,370,713

[45] Jan. 25, 1983

[54] ANTI-TIGHTLINE CONTROL SYSTEM AND METHOD FOR DRAGLINE TYPE EQUIPMENT

[75] Inventors: Charles E. McCoy, Jr., Erie, Pa.; James L. Crowgey, Roanoke, Va.

[73] Assignee: General Electric Co., Schenectady, N.Y.

[21] Appl. No.: 177,256

[22] Filed: Aug. 11, 1980

[51] Int. Cl.[3] ..... G06F 15/46

[52] U.S. Cl. ..... 364/424; 37/116; 212/153; 340/685

[58] Field of Search ..... 364/400, 420, 424, 463; 37/116, 189, DIG. 1; 212/124, 153, 154, 155; 340/685; 414/625; 299/1; 175/24, 50, 62

[56] References Cited

U.S. PATENT DOCUMENTS

| | | | |
|---|---|---|---|
| 3,636,325 | 1/1972 | Chytil | 364/400 X |
| 3,934,126 | 1/1976 | Zalesov et al. | 364/424 |
| 4,035,621 | 7/1977 | Kemp | 364/424 X |
| 4,052,602 | 10/1977 | Horn et al. | 364/424 |
| 4,185,280 | 1/1980 | Wilhelm | 364/424 X |

OTHER PUBLICATIONS

Chironis—"Computer Aids Dragline Operator"—Coal Age—Mar., 1978—pp. 58-64.

*Primary Examiner*—Joseph F. Ruggiero
*Attorney, Agent, or Firm*—Vale P. Myles

[57] ABSTRACT

An anti-tightline control system and method which monitors the hoist and drag rope-in length of dragline type equipment, and in the event that certain preset levels are exceeded, the control system functions to slow the hoist and drag rope drives, initiate a warning to the operator of the dragline equipment, and if required, stops the hoist and drag rope drives. The control provides a limit to a voltage reference signal from the operator's hoist and drag master control for the hoist and drag drive motor voltage regulators under static or dynamic tightline operating conditions to automatically reduce the speed of both the hoist and drag rope drives towards zero as the amount of net rope-in increases. For certain specialized dragline equipments having specially-shaped tightline limit boundary characteristics, the control system makes available a function generator for establishing a shaped tightline limit boundary instead of the elliptical tightline boundary used with other types of equipment. Additional reference circuits are provided for converting the form of control signal derived at the output of the anti-tightline control system into a different form suitable for use with the form of signal required by a particular equipment.

33 Claims, 17 Drawing Figures

FAMILY OF LIMIT CURVES
FOR VARIOUS HOIST AND DRAG
ROPE SPEEDS 5 SECONDS
PRIOR TO BOOM COLLISION

20
TLAG
33
TLAO
14
3-1
16
TO 7B
20
2
TO FIG. 7D
TO 7B
+1 VOLT CLAMP
TO 7B
-15 VOLT CLAMP
+50 VOLTS
TLATC
TO FIG. 8

| FIG.7A | FIG.7B | FIG.7C | FIG.7D |
|---|---|---|---|

PROHIBITED DRAG ROPE-IN VS. HOIST ROPE-IN FUNCTION GENERATOR CIRCUIT

ANTI-TIGHTLINE CONTROL SYSTEM AND METHOD FOR DRAGLINE TYPE EQUIPMENT

BACKGROUND OF INVENTION

1. Field of Invention

This invention relates to controlling operation of dragline equipment of the type employing an extended boom from which a bucket is suspended by means of a hoist rope or cable and a drag rope or cable that are attached to the bucket and either paid-out or taken-up by respective hoist rope and drag rope winches. By appropriately positioning the boom and either paying-out or taking-up the respective hoist and drag ropes, an operator of the equipment causes the bucket to excavate soil or other material from selected locations to a desired depth, or do other similar work.

More particularly, the invention relates to a new and improved anti-tightline control system and method for automatically overriding the operator's setting of the controls for dragline type equipment in order to avoid tightlining the equipment. The novel control system and method also simultaneously signals the operator that a tightline condition is imminent and also, if necessary, serves to shut down the equipment automatically before a threatened tightline condition can occur.

2. Background Problem

FIGS. 1 and 2 are schematic illustrations which depict typical dragline equipment and the environment in which such equipment is used and are useful in defining the problem to which the present invention is directed. The dragline type equipment is comprised by a cab 11 mounted on treads or otherwise so that the cab can be moved about on the ground from one location to another for excavation or other similar work which needs to be done. Attached to the base frame of the cab is an extended boom 12 which can have lengths up to and exceeding 300 feet, for example. Supported from the end of the boom 12 is a bucket which can be raised or lowered in the vertical direction by a hoist rope 14 that extends upwardly from bucket 13, along the length of boom 12 and to a rotatable winch, spool or drum supported within cab 11. The drum is driven by a motor for paying-out or taking-up the hoist rope 14 thus lowering or raising bucket 13. Also attached to the bucket 13 is a drag rope 15 which also extends to a rotatable winch, spool or drum on cab 11 that is driven by an electric motor for causing the drag rope 15 to be paid-out or taken-up thereby causing bucket 13 to move away from or toward the cab 11. By appropriately rotating the cab 11 and hence boom 12 to a desired angle and dropping the bucket 13 to the bottom of a hole or pit being excavated, and thereafter drawing in the drag rope 15 to fill the bucket 13 to a desired degree and subsequently raising the bucket via the hoist rope and rotating the cab around to a desired deposit point, the dragline type equipment accomplishes its work of excavating the pit. In the arrangement shown in FIGS. 1 and 2 the dragline 11 is positioned at a high point on the land adjacent the pit being excavated (referred to as the bench) and the bucket 13 lowered, dragged, raised, rotated to deposit, and then rotated back in the above briefly described cycle. Other arrangements can be visualized when the dragline is situated on a bench below a bank to be removed, etc. However, the arrangement of FIG. 1 is believed to suitably illustrate a typical situation wherein a tightlining problem to which the present invention is directed, can arise.

It will be appreciated by the reader that while FIGS. 1 and 2 illustrate a particular type of dragline wherein an actual bucket is moved to perform excavation of earth or other similar materials there are other types of equipment such as cargo cranes and the like which employ a large holding magnet, a claw, a platform or other device for performing work. Thus in the present specification the term "dragline type equipment" has been employed to identify all such equipment wherein a tightlining problem might arise and the term "bucket means" has been employed to identify all such devices as a bucket, magnet, cargo platform, etc. Further, while in the illustrations of FIGS. 1 and 2, hoist and drag ropes have been described, it is believed equally obvious that the hoist and drag ropes could comprise hoist and drag cables, hoist and drag chains, hoist and drag lines, or other similar items which could be employed in place of the rope and hence the term "rope means" has been employed to encompass all such similar items.

From a consideration of FIG. 1 it will be appreciated that a given amount of hoist rope on or off the hoist rope winch drum represents a given bucket height measured from the tip of boom 12 if the bucket is hanging vertically. If the bucket is dragged in from the solid line position to the dotted line position shown in FIG. 1, there will be a certain length of drag rope on or off the drag rope winch drum as the bucket 13 is made to depart from the vertical below the boom tip. This dragging in of the bucket causes an increase in compressive stress and an increase in bending moment on the boom 12. If thereafter, continued operation of the hoist rope winch and/or the drag rope winch in the take-up direction causes these stress levels to exceed certain design limits established for the boom by a manufacturer of the dragline equipment, such increased stress levels beyond the design limits can be detrimental to the boom system. This detrimental condition is called tightlining.

In addition to the tightline condition described in the preceding paragraph with respect to FIG. 1, which will be referred to hereafter as a static tightline condition, a further condition can be brought about whereby the dragline bucket 13 is caused to collide with the boom. This shocking of the boom condition will be referred to as a dynamic tightline condition. A dynamic tightline condition can occur if the bucket velocity is of such a magnitude that it is virtually "thrown" into the dragline boom. This can occur if the angular relationship, indicated as the angle $\phi$ shown in FIG. 2, between the hoist and drag ropes approaches or exceeds 180°. It is possible by means of the present invention to detect that a boom collision is imminent by using drag and hoist rope lengths and speeds. Such a detected condition can then be used to prevent or warn against any further operator action which would worsen this condition. This is called a dynamic anti-tightline control feature which when coupled with the ability to detect and limit bucket position so as to avoid a static tightline condition as described above with relation to FIG. 1, provides a preferred form of anti-tightline control system for avoiding both static and dynamic tightline conditions.

The reader will obtain a better appreciation of the need for an anti-tightline control system according to the invention from a consideration of FIG. 3 of the drawings which illustrates a family of limit curves for various hoist and drag rope speeds 5 seconds prior to boom collision. In FIG. 3, the boom 12 is indicated to be 300 feet long and disposed at an angle of 30° relative to horizontal. In the vertical scale, the distances measured are relative to distance above and below the bench. The five elliptically shaped limit curves are for different combined lengths of hoist and drag rope under conditions where either the hoist or drag rope or both are being taken-up at the speeds noted. The speeds are noted in parts per unit (p.u.) where 1.0 p.u. speed equals 15 feet per second. Thus, a speed of 0.5 p.u. would correspond to a speed of 7.5 feet per second.

In considering FIG. 3, one should keep in mind the practical problem confronting operators of dragline type equipment. In the situation depicted in FIGS. 1 and 2, the bucket 13 when loaded must be lifted above the bench, the cab and boom rotated to the deposit location and thereafter rotated back and the bucket dropped to complete an excavation cycle. For maximum efficiency of operation, it is not unusual for an operator when the bucket is at the bottom of the pit, as shown in FIGS. 1 and 2, to raise the bucket at a maximum speed to the point above the bench where the boom can be rotated towards the deposit location. From a consideration of FIG. 3, it will be seen that if both the hoist and drag ropes are taken-up at 1.0 p.u. speed the limit curve 5 seconds before boom collision occurs at the point when there is still 460 feet of combined hoist and drag rope paid-out. If only the hoist or only the drag rope is taken up at 1.0 p.u. speed then the limit is at 380 feet of combined hoist and drag rope. Such a situation is very difficult for even an experienced operator to visualize and react to even if he is provided with input measurement signals which convey the above noted information to him.

From the foregoing brief description, the reader will appreciate that not all operating phases of dragline type equipment can give rise to either a static or dynamic tightline operating condition. The situations wherein tightlining can occur are listed in the following anti-tightline logic table together with an indication of what actions a well designed anti-tightline control system should provide.

ANTI-TIGHTLINE LOGIC TABLE

| Drag Function | Hoist Function | Condition | Result with Trip-Out System | Result with Regulating System |
|---|---|---|---|---|
| 1. Pay out | Lower | Tightline not possible | No corrective action required | |
| 2. Pay out | Neutral | Tightline not possible | No corrective action required | |
| 3. Pay out | Hoist | Tightline | Trip-Out | Reduce hoist speed |
| 4. Drag in | Lower | Tightline | Trip-Out | Reduce drag speed |
| 5. Drag in | Neutral | Tightline | Trip-Out | Reduce drag speed |
| 6. Drag in | Hoist | Tightline | Trip-Out | Reduce hoist speed |
| 7. Neutral | Lower | Tightline not possible | No corrective action required | |
| 8. Neutral | Hoist | Tightline | Trip-Out | Reduce hoist speed |

The present invention provides an anti-tightline control system and method which includes the ability to detect and limit bucket position to avoid a static tightline condition as described with relation to FIG. 1 and also the ability to detect and limit bucket position and velocity in order to avoid a boom collision (dynamic tightline condition) as shown in FIG. 2. The limit function is not restricted to a warning and trip-out type of system but also includes the functional means to cause a control regulating action to occur. The regulating action takes over control of the dragline equipment and slows down or ultimately stops the drag and/or hoist motors for logic conditions indicated as 5, 6 or 8 of the logic table set forth above. For logic conditions 3 and 4, this regulating function reduces and ultimately stops the drag or hoist motion drive motor. In the case of pay-out of the drag rope and/or lowering of the hoist rope, these functions are not affected since neither can lead to a tightline operating condition. All of the above suggested limiting actions will cause the bucket to traverse along the dynamic tightline limit curve, even though an operator signal would otherwise cause a tightline condition to occur. The word tightline as used in the above logic table as well as hereinafter in this disclosure, should be construed to mean both static and dynamic tightline if neither one is specified.

SUMMARY OF INVENTION

It is therefore a primary object of the present invention to provide a novel anti-tightline control system and method for controlling operation of the drag regulating systems of dragline type equipment by deriving an anti-tightline control regulating signal for automatically overriding the operation control settings under threatened tightline operating conditions, and for regulating further take-up of the hoist and drag ropes so as to avoid an incipient tightline operating condition while maintaining continued productive operation of the dragline type equipment.

In practicing the invention a drive regulating method and system is provided for dragline type equipment having respective hoist and drag ropes which can be taken-up or paid-out by an operator to control the positioning and operation of a bucket for doing work, and which can be so operated as to place the dragline type equipment in a tightline condition that in turn could result in damaging the equipment. The method and system of the invention controls operation of the drive regulating system by deriving an anti-tightline control regulating signal for overriding the operator controlled setting under threatened tightline operating conditions and for regulating further take-up of the hoist and/or drag ropes so as to avoid a tightline operating condition while maintaining continued operation of the dragline type equipment. This is achieved by deriving respective hoist rope and drag rope position electric signals which are indicative of the length of hoist and drag rope paid-out or taken-up at any given instant of time. A maximum hoist plus drag rope length allowed-in bias signal is derived from calculations based on data supplied by a manufacturer of the dragline type equipment with which the anti-tightline control is to be used, and is preset into the control by means of a potentiometer or other suitable electric signal generator. The preset signal is representative of the maximum length of hoist plus drag rope allowed to be taken-up and still avoid a tightline condition if the rope velocities are near zero. The combined hoist and drag rope position electric signals are then compared with the preset maximum hoist plus drag rope length allowed-in bias signal. If the combined hoist and drag rope position electric signals exceed the rope allowed-in bias signal, an output signal is derived for regulating and controlling further operation of the dragline type equipment while avoiding a tightline operating condition during continued operation of the equipment. In preferred embodiments of the invention, the hoist rope and drag rope position signals are algebraically summed and this algebraic sum is differentiated in order to derive a net rope velocity signal whose magnitude is representative of the speed at which the hoist and drag ropes are being paid-out or taken-up and whose polarity is indicative of whether the algebraic sum of the hoist and drag ropes combined lengths is being taken-up or paid-out. The net rope velocity signal is added into the comparison of the hoist and drag rope position signals to the maximum hoist and drag rope length allowed-in bias signal to in effect dynamically vary the absolute value of the rope allowed-in bias signal in accordance with the ropes net speed, and thereby dynamically vary the anti-tightline boundary in a direction to decrease the value of the maximum combined rope lengths allowed-in for increasing rope take-up speeds.

For those dragline type equipments having a specialized static tightline boundary operating condition characteristic which is non-elliptical in nature, the system and method further comprises processing the hoist rope position electrical signal in a suitable function generator whose transfer function corresponds to the specialized static tightline boundary operating condition characteristic of the dragline type equipment. At the output of the function generator a drag rope-in prohibited signal is derived for use in place of the hoist rope position signal otherwise used in the comparison with the other input signals to derive the output difference control signal for regulating and controlling continued operation of the dragline type equipment.

In addition to the above described features, preferred embodiments of the system include clamping the output anti-tightline boundary limited control signal to a range of values extending between an allowed first value corresponding to full speed operation of the dragline equipment and an allowed second value corresponding to shut-down of the equipment. As backup protection, a warning signal to an operator of a dragline type equipment is derived in the event that the value of the output anti-tightline boundary limited control signal exceeds a predetermined first limit value indicative that the dragline type equipment is approaching a tightline operating condition, and a shut-down signal is provided which trips-out or otherwise stops further operation of the dragline type equipment in the take-up direction in the event that the anti-tightline boundary limited control signal exceeds the first limit value by a predetermined amount. Additionally, the warning and shut-down signals are recalibrated according to net drag and rope velocity just as the regulating signal is recalibrated, such that the warning and shut-down occur with less net hoist and drag rope in for a greater velocity of net rope being taken in. For those types of dragline type equipment which utilize regulating controls requiring a different form electrical input signal than that ordinarily provided by the anti-tightline system of the invention, the form of the anti-tightline boundary limited control signal derived from the output of the anti-tightline control system is converted to a different form compatible with the form of control regulating signal required by the particular operator controlled hoist and drag rope drive regulating means of the dragline type equipment in question.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference character and wherein.

DETAILED DESCRIPTION OF PREFERRED EMBODIMENTS

From the foregoing description it will be appreciated that it is possible to detect when the drag and hoist rope lengths are such that a tightline condition is either threatened or exists. Such a detected condition can then be used to prevent or warn against any further operator action which would worsen the condition. An anti-tightline control system for implementing this protection action can be implemented with two possible approaches;

1. A functional means can be provided by which a relay signal is generated whenever a tightline condition occurs or is threatened. This relay signal would be used to signal the operator that a tightline condition has occurred or is threatened. In addition, another relay signal could be generated if the threatened or existing tightline condition progressed beyond the initial tightline limit by some predetermined amount, for example 10–20%. This additional 10–20% signal could be used to cause a trip-out of the drag and hoist functions. This trip-out also can be used to cause drag and hoist brakes to be set, preventing any further progression into the tightline condition. In order to back the bucket out of this trip-out position, a reset function on the part of the operator would be required whereby the reset would allow restoring pay-out of either the hoist or drag ropes or both until the initial tightline signal relay drops out thereby restoring the equipment to normal operation.

2. A functional means can be provided which causes a control regulating action to occur. This regulating action would be to slow down and ultimately stop the drag and/or hoist motors for logic conditions 5, 6 and 8 of the preceding logic table. Otherwise, for logic conditions 3 and 4, the regulating function would reduce the speed of the drag and/or hoist motors (either or both if required) in order to cause the bucket to traverse along a characteristic tightline limit curve for the dragline type equipment with which the control is being used. This regulating function would preclude the need to rely on the alarm and trip-out feature described in (1) above for the majority of threatened tightline conditions. However, for system backup, both the alarm and trip-out features preferably are included.

Figure 1:
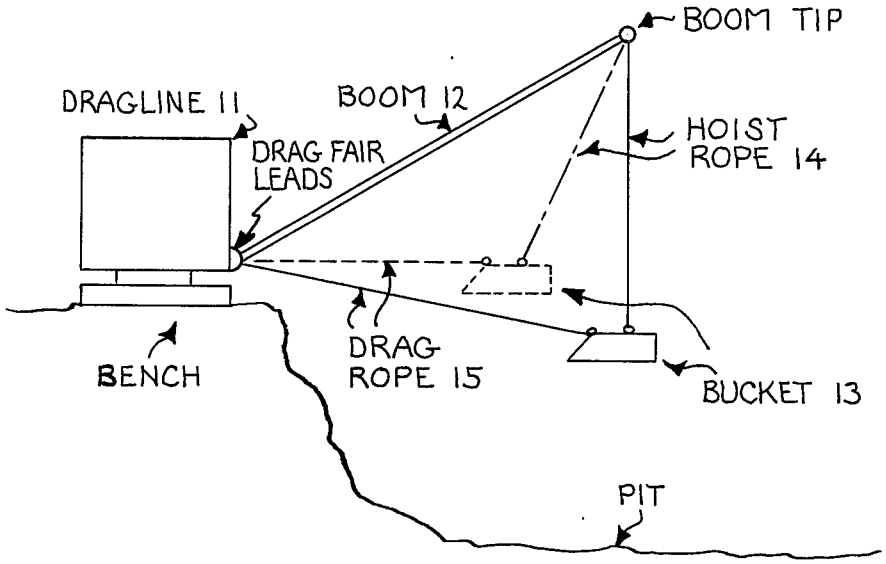
FIGS. 1 and 2 are schematic functional diagrams illustrating dragline type equipment to which the invention relates and are helpful in defining the tightlining problem which the invention overcomes.
Figure 2:
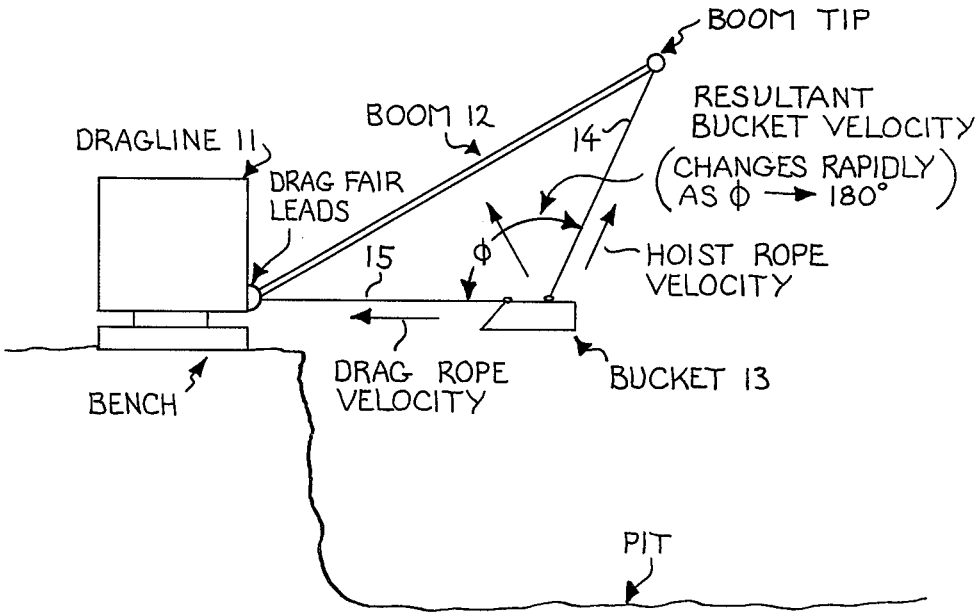
Figure 4:
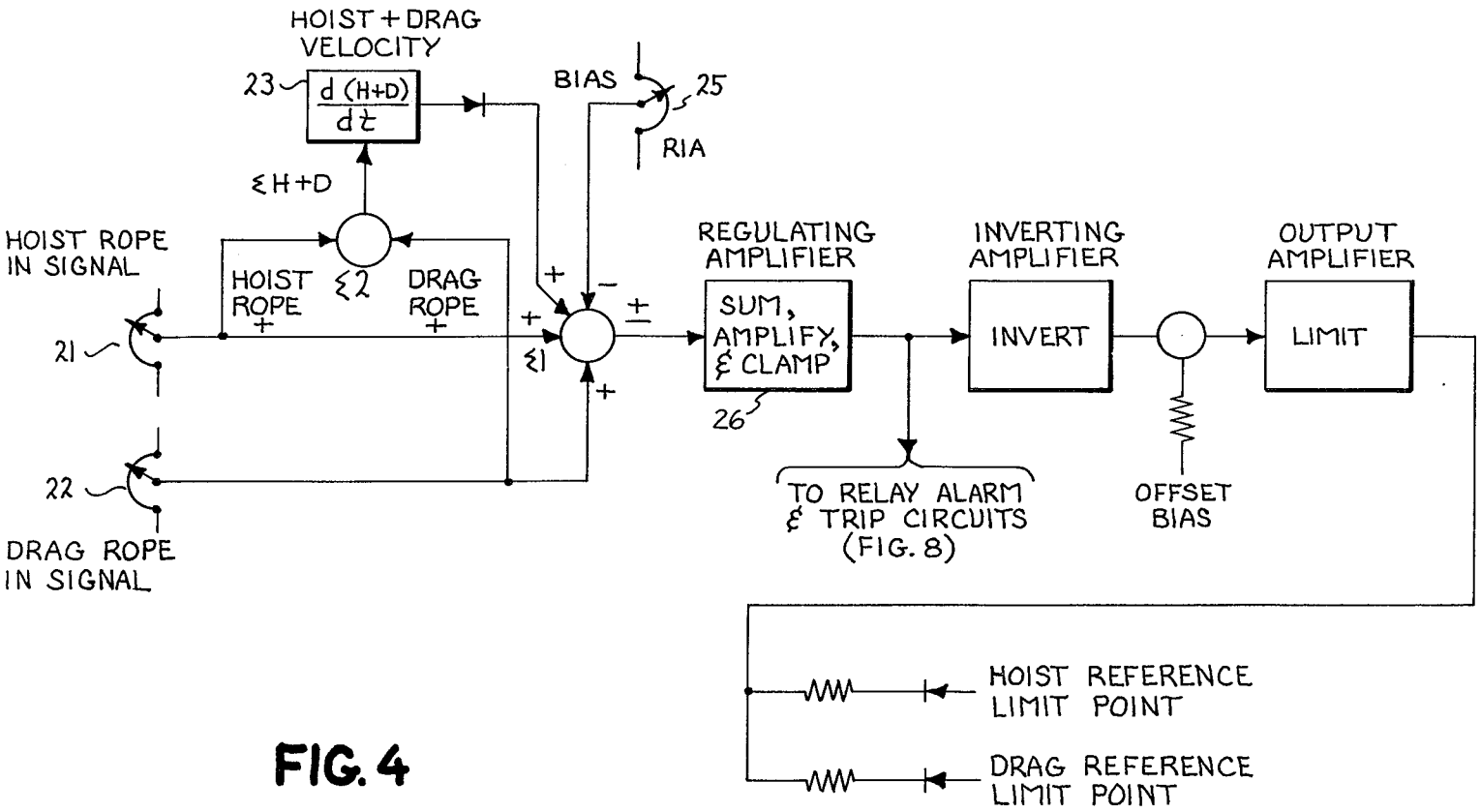
FIG. 4 is a functional block diagram of an anti-tightline control system according to the invention and is helpful in illustrating the nature and manner of deriving certain essential signals employed in the anti-tightline control system.

In addition to the alarm, trip-out and regulating features described above, it has been determined that the boundary region or limit curve for dynamic tightline conditions (as described above with reference to FIG. 2) can be closely represented by an elliptically-shaped curve under the boom. When the difference in rope speeds is low, the elliptical curve is close to the boom. When the difference in rope speeds is high, the curve will be further away from the boom thereby indicating that a greater length of combined hoist and drag rope length must be in a paidout condition. The anti-tightline characteristic boundary or curve of any dragline type equipment is defined by an elliptically-shaped curve under the boom which is the loci of points where the lengths of drag rope and hoist rope extending from the boom equal a constant. Because of this relationship, a special function generator is not required in order to implement the dynamic anti-tightline scheme for a large number, if not most, dragline type equipments. A basic control scheme which is capable of implementing the control features listed in items 1 and 2 in the preceding paragraph as well as providing dynamic anti-tightline control protection for those types of dragline equipment whose tightline characteristic curves under the boom are elliptically-shaped in nature, is illustrated by the functional block diagram of FIG. 4. In FIG. 4 a hoist rope-in signal generator is shown at 21 for generating a hoist rope signal that is a measure of the length of hoist rope that is reeled into the dragline. A drag rope-in signal generator shown at 22 develops a drag rope signal which is a measure of the length of drag rope that is reeled into the drag line. These signal generators may comprise any suitable means such as a digital shaft encoder or a potentiometer driven by or in synchronism with the drums or spools on which the hoist rope/drag rope are wound while being taken-up or paid-out. The two rope length signals generated by 21 and 22 are fed to a summing junction 1 where they are added together. These two rope length signals are always positive as indicated by the positive polarity sign going into summing junction 1.

A net rope velocity signal is derived by algebraically summing the two rope length signals 21 and 22 at summing junction Σ2, and differentiating this algebraic sum by means of differentiating circuit 23. This velocity signal can be either positive polarity (+) or negative polarity (−) depending on whether more rope is being taken-in or paid-out. This net rope velocity signal is then fed through a diode to summing junction 1. A separately developed rope-in allowed bias signal in the form of a fixed negative bias voltage is derived from a rope-in allowed (RIA) potentiometer 25 that also is supplied into junction 1. This fixed negative bias voltage is adjusted to equal the sum of hoist and drag rope lengths that can be allowed if the rope speeds are near zero velocity before anti-tightline action will commence. The effect of the net speed signal is to provide an additional positive signal which adds to the positive hoist and drag rope-in signals in order to change the maximum allowed rope-in to a smaller value for increasing net rope speeds in the take-up direction. The comparison of hoist rope-in and drag rope-in length plus net rope velocity versus rope-in allowed bias is made at junction 1. The difference is amplified for the desired scaling by regulating amplifier 26. The output from regulating amplifier 26 is supplied to the relay alarm and trip circuits to be described more fully hereinafter in connection with FIG. 8 of the drawings. The output from the regulating amplifier is inverted by another amplifier and then supplied to an output amplifier, which operates to limit the maximum reference to the hoist and drag motion regulators during anti-tightline operation.

Figure 3:
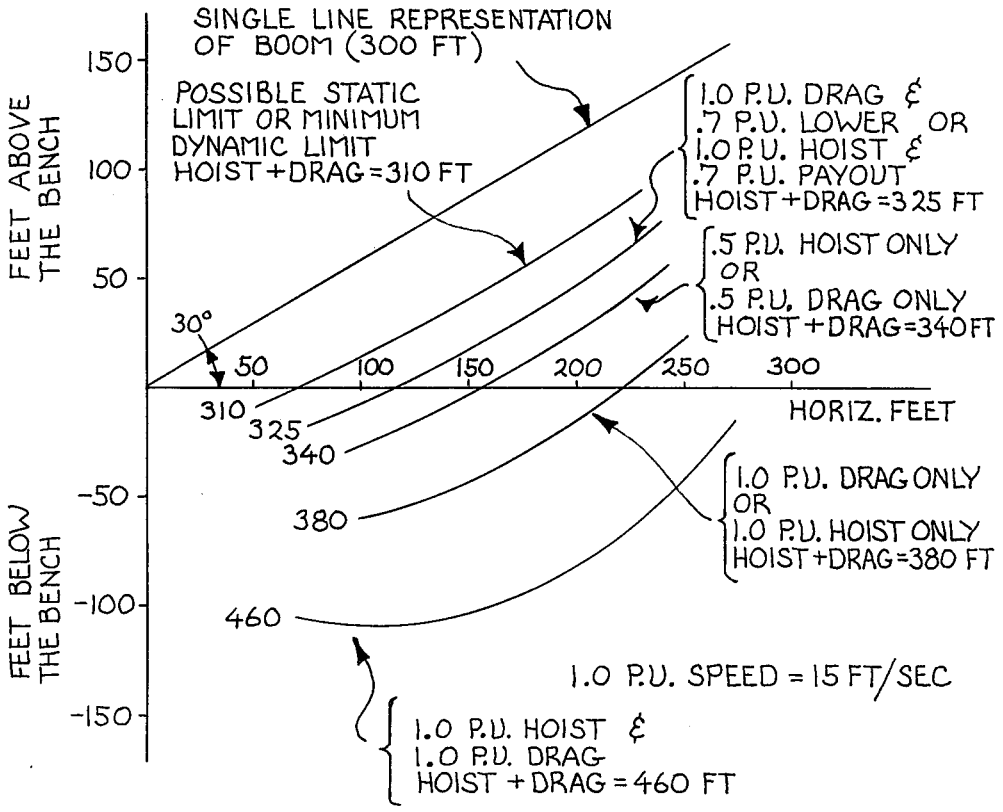
FIG. 3 is a family of limit curves for various hoist and drag rope speeds 5 seconds prior to boom collision and are useful in defining dynamic tightlining and relating it to experience in the field.

For the sake of clarification, the changing dynamic tightline limit curves illustrated in FIG. 3 of the drawings should be considered with the following explanation. If one rope length signal, for example the hoist rope length, is being hoisted or taken-up at a faster rate than the drag rope is being paid-out, then the effect on the minimum limit curve is proportional to the difference in rope speeds. Therefore, the minimum limit is not affected as greatly as it would be if only the hoist rope-in signal were being fed to the summing junction 2. This coincides with the required change in minimum limit for various differential rope speeds as shown in FIG. 3. For example, consider that the hoist rope is being taken-up at a speed of 0.5 p.u. In this regard the measure p.u. means part per unit and one part per unit (1 p.u.) is defined as 1 p.u. = 15 ft. per second. If now it is assumed that the hoist rope only or the drag rope only is being taken-up at a speed of 0.5 p.u. then according to FIG. 3 the minimum hoist and drag rope-out will be equal to 340 feet and will apply whenever the difference between the rope speeds is equal to 0.5 p.u. This difference is determined by algebraically adding the rope lengths. Therefore, for a +1.0 p.u. hoist rope length and a −0.5 p.u. drag rope length (where—actually indicates pay-out) the differential is $+1.0-0.5=0.5$ p.u.

Figure 12:
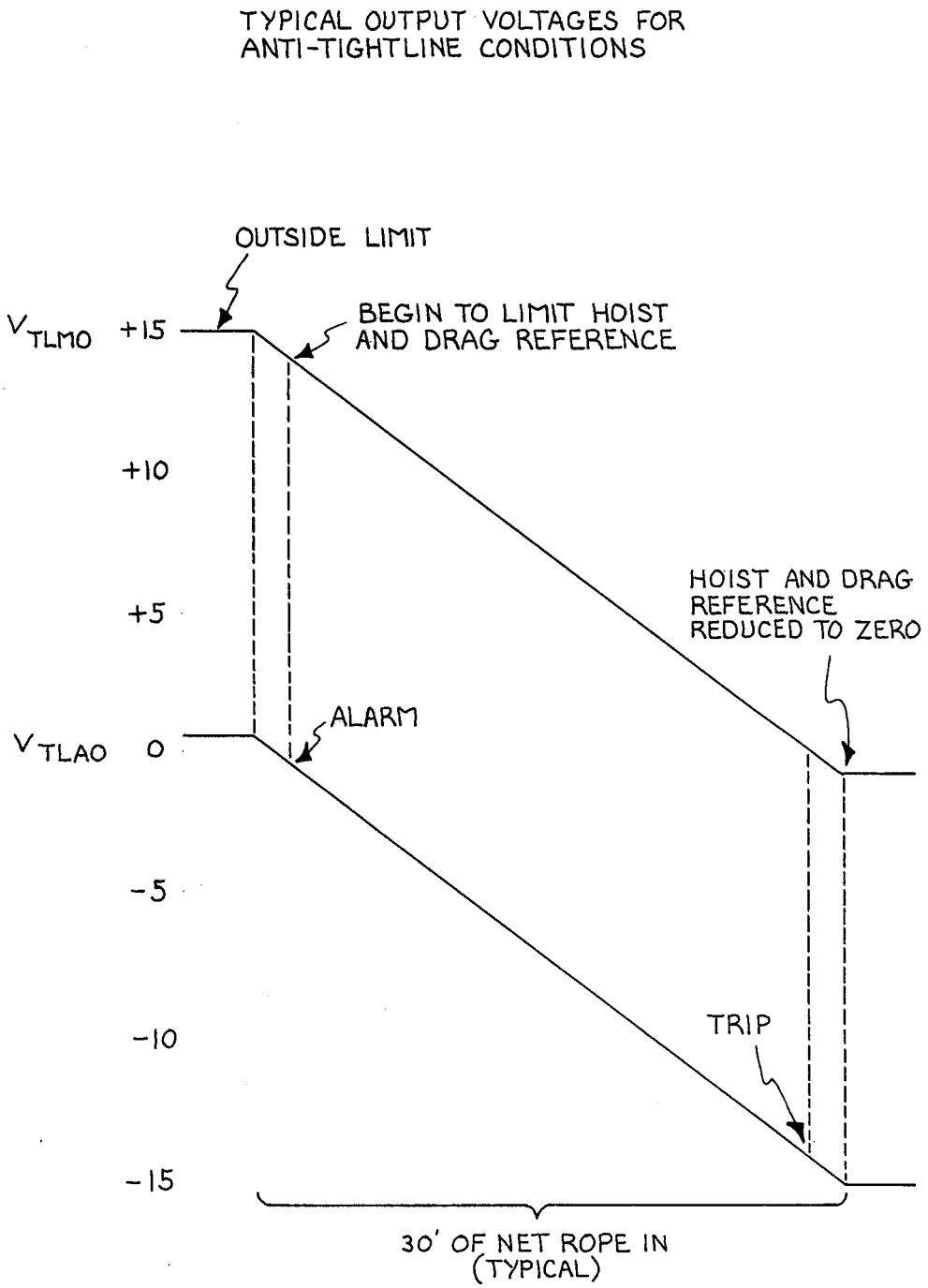
FIG. 12 is a graph depicting typical output voltages from amplifiers in the alarm and limiting circuits of the invention during certain anti-tightline conditions.

Refer to FIG. 12 for a graphical depiction of the output voltage from the regulating amplifier providing the anti-tightline alarm output TLAO and the output amplifier limiting the hoist and drag reference identified as anti-tightline module output TLMO, during anti-tightline conditions.

The circuit is designed so that if the error output signal from summing junction 1 to the regulating amplifier block passes through zero moving from negative to positive, then limiting action will begin. The amplifier 26 output (TLAO) begins to move in a negative direction from a normal low positive voltage of approximately +1 volts through 0 volts toward a value of −15 v. As a result, the output amplifier output (TLMO) begins to move in a negative direction from a normal +15 v through 0 volts toward a low negative voltage of approximately −1 v. The rate that these voltage reductions occur as the error signal from summing junction 1 increases in the positive direction, is determined by the gain of the regulating amplifier 26. Whenever the error signal from summing junction 1 into the regulating amplifier 26 is negative in polarity, the regulating amplifier output is at a maximum +1 volts due to clamping circuits as will be described more fully hereinafter in connection with FIG. 7.

Figure 5:
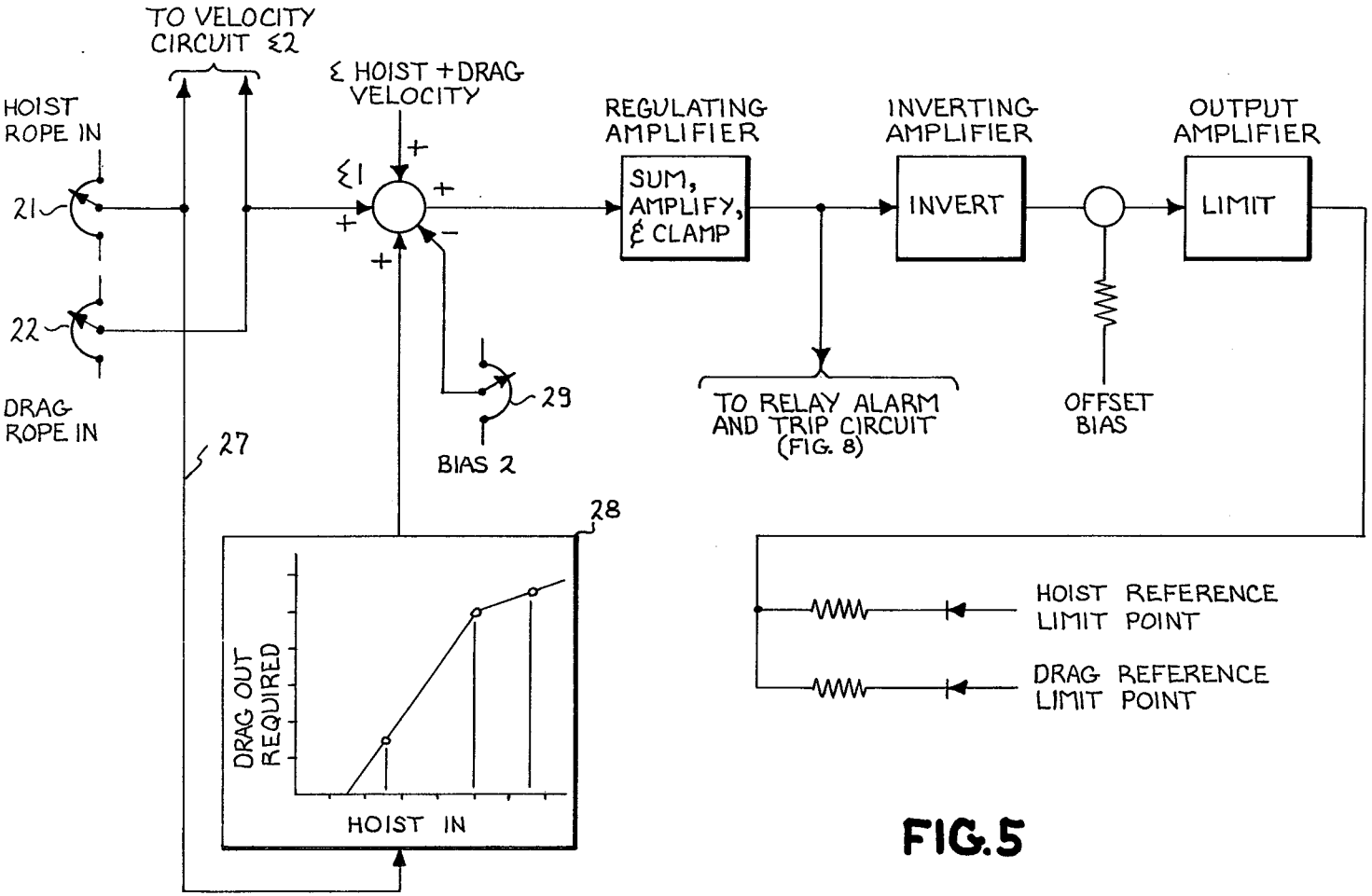
FIG. 5 is a functional block diagram of a modification of the system showin in FIG. 4 required for certain specialized types of dragline equipment.

In order to accommodate various tightline limit curves which will vary for each original equipment manufacturer of dragline type equipment, and perhaps for each machine, a function generator circuit may be required to translate the linear rope length or position measurements into the required tightline limit which is defined as the boundary between the optimum operating region for the dragline type equipment and the adverse boom stress region. With reference to FIG. 3 of the drawings, it should be noted that if the elliptically-shaped curves are cross plotted into curves having as coordinates the hoist rope length plotted against the drag rope length, the resulting cross plot will appear essentially as straight lines. Strictly speaking, a function generator would not be required to obtain these straight line relationships. Thus, for dragline type equipment whose tightline limit curves are essentially elliptical in nature, nothing further in the way of circuitry would be required in addition to that depicted in FIG. 4 of the drawings. However, for applications where the static and dynamic tightline boundary curves are significantly different, then additional circuitry is required in the form of a function generator scheme as illustrated in FIG. 5 of the drawings. As shown in FIG. 5, the hoist rope length or position signal is supplied over a conductor 27 to a function generator circuit 28. The function generator circuit 28 has designed into it a specialized transfer function such as that illustrated in block 28 whereby for a given value hoist rope length input signal, a corresponding amount of drag rope length-out (not taken-up or coiled on the drag rope winch spool or drum), is required. This drag rope-out required signal then is supplied as an output from the function generator 28 through a summing point 1. In addition, summing point 1 has supplied to it the drag rope length or position signal from the drag rope encoder 22 and a negative polarity rope-in allowed bias signal from a potentiometer 29. Thus it will be appreciated that the summing point 1 sums together the drag rope required to be out for the amount of hoist rope-in signal derived from function generator 28 and supplies any difference or error signal to regulating amplifier 26. The error output signal from summing point 1, described earlier with relation to FIG. 4, is also supplied to regulating amplifier 26. Thus, only the resultant positive signal from summing junction 1 will control the anti-tightline limiting regulating action of amplifier 26.

Figure 6:
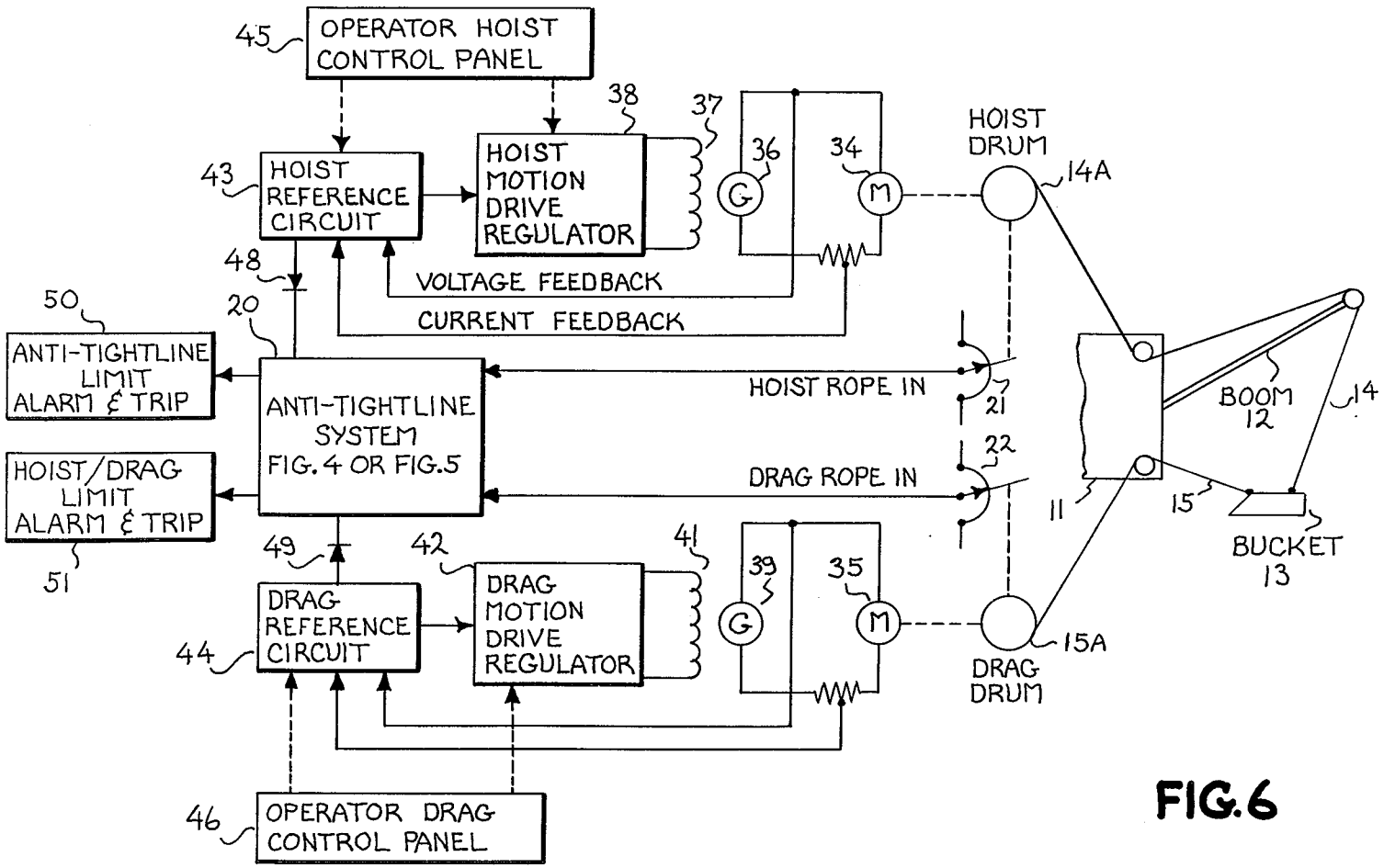
FIG. 6 is a functional block diagram of an overall dragline type equipment hoist and drag motion control regulating system and illustrates the manner in which the anti-tightline control system of the invention is employed in controlling operation of the dragline type equipment.

From the foregoing description, it will be appreciated that the anti-tightline control system can have either the form illustrated by FIG. 4 or the form illustrated by FIG. 5 which has added to it those constituent parts of the FIG. 4 system such as summing point 2 not shown in the FIG. 5 system. FIG. 6 of the drawings is a functional block diagram of an overall dragline type equipment hoist motion and drag motion regulating control system employing the anti-tightline control system of either FIG. 4 alone or with FIG. 5. In FIG. 6 the drag line type equipment being controlled is shown at 11 together with the boom 12, bucket 13, hoist rope 14 and drag rope 15. Hoist rope 14 is taken-up (hoisted) or paid-out by a hoist drum 14A and drag rope 15 is taken up or paid-out by the drag rope drum 15A. The hoist rope position or length encoder 21 is shafted to and mechanically driven by the hoist drum 14 and supplies its output signal back to the anti-tightline control system 20 and the drag rope length or position signal encoder 22 is mechanically driven by the drag drum 15A and supplies its output signal back to the anti-tightline control system 20. As mentioned earlier, the anti-tightline control system 20 may comprise either the system of FIG. 4 alone or with that of FIG. 5, depending upon the anti-tightline boundary characteristics of the dragline type equipment 11 and its boom system 12–15. Hoist drum 14A is mechanically shafted to and driven by a hoist drive motor 34 and the drag drum 15A is mechanically shafted to and driven by a drag drive motor 35. Hoist drive motor 34 comprises a part of a classical, generator motor drive system wherein the motor 34 field windings and/or rotor windings are excited by a variably controlled electric current supplied from a generator 36 whose field winding 37 is in turn regulated or controlled by hoist motion drive regulator circuit 38. Drag drive motor 35 is similarly driven by an excitation generator 39 whose field 41 is variably controlled by a drag motion drive regulator circuit 42. The hoist motion drive regulator 38 and drag motion drive regulator 42 are in turn controlled from respective reference circuits 43 and 44 whose construction may be as shown either in FIG. 10 of the drawings or FIG. 11 of the drawings depending upon the nature of the motion drive regulators 38 and 42. As will be described more fully hereinafter with relation to FIGS. 10 and 11, the reference circuits 43 and 44 are variably controlled manually by an operator of the equipment through respective operator hoist and drag control panels 45 and 46. The output difference signal derived from the anti-tightline control system 20 also is supplied through isolating diodes 47 and 48 to the reference circuits 43 and 44, respectively, in order to complement or override the operator settings imposed on the reference circuits via the operator hoist and drag control panels 45 and 46. The anti-tightline control system outputs are also supplied to an anti-tightline limit alarm and trip circuit 50 and to a hoist and drag rope length limit alarm and trip circuit 51 as will be described more fully hereinafter in connection with FIG. 8 of the drawings. In addition to the operator and anti-tightline control system inputs, each of the reference circuits 43 and 44 have respective voltage feedback and current feedback signals derived from the motor control systems 34, 36 and 35, 39, respectively supplied thereto as inputs whereby stable and reliable motion drive regulation of the respective hoist and drag drive systems can be achieved.

In operation, an operator of the dragline type equipment sets the reference input signal supplied by the reference circuits 43 and 44 to the hoist motion drive regulator 38 and drag motion drive regulator 42, respectively. These operator set reference inputs will cause the motion drive regulator to provide a certain level of excitation current to the field windings 37 and 41 respectively which in turn result in an output excitation current being supplied from the generators 36 and 39 to the respective hoist and drag drum drive motors 34 and 35. The level of these excitation voltages in turn sets the speed at which the hoist drum or drag drum is rotated, and the direction of excitation (as determined by the operator set reference input signal polarity) determines whether the hoist and drag drums are rotated in a direction to pay-out or take-up, respectively. If the operator settings are such that it is not possible for a tightline condition to occur, as established by the anti-tightline logic table set forth earlier, then the anti-tightline control system 20 output will be in a direction and of a value such that it does not affect operation of either the hoist or drag motion drive regulator systems. If on the contrary, the reference inputs are such that any of logic conditions 3-6 or 8 are encountered, then the anti-tightline control system will take over by overriding the operator settings in the reference circuit and regulate either the hoist or drag motion drive regulator 38 or 42, or both, in a direction so as to reduce hoist or drag rope speed or stop the apparatus completely. Simultaneously, the anti-tightline limit alarm may be sounded and if the trip is actuated due to excessive tightlining, the equipment will shut down. Lastly, consider an operating condition whereby the operator has the control set, for example, for payout of drag and hoist-in and the sum of the drag and hoist rope-out always is greater than the value used to determine the preset minimum bias adjustment. Under such conditions it still is entirely possible for the bucket to be run into the boom tip. To prevent such occurrence the hoist and drag limit alarm and trip circuit will function in accordance with the warning generated by operation passing through the first level setting and finally trip-out as described previously.

FIGS. 7, 7A, 7B and 7C through 11 of the drawings show detailed circuit diagrams of the best mode of practicing the invention known to the inventors at the time of filing this application. As depicted in FIGS. 7, 7A, 7B, 7C and 7D, if horizontally aligned comprise an overall detailed circuit diagram of the preferred system. Starting with FIG. 7A, the hoist rope-in potentiometer (HRIP) shown at 21 is geared to the hoist rope drum as illustrated in FIG. 6 and the drag rope-in potentiometer (DRIP) shown at 22 is geared to the drag rope drum of a dragline type equipment in the same manner as shown in FIG. 6 of the drawings. These potentiometers provide analog output signals which are proportional to the hoist rope-in length and the drag rope-in length, respectively. The anti-tightline control module illustrated generally at 20 monitors the length of hoist and drag rope-in, and in the event that preset levels are exceeded, the module functions to slow the hoist and drag drives, and initiate a warning to the operator, and if required, stops the hoist and drag rope drum drive motors. To accomplish this, the control module shown in FIGS. 7-7C and the ancillary circuits accompanying it shown in FIGS. 8-11 perform the following listed functions:

1. Compares the total amount of hoist plus drag rope-in length against a preset value of rope-in allowed to establish an elliptical tightline boundary under the boom.

2. Differentiates the rate of change of rope-in length to provide a dynamic tightline boundary further from the boom as determined by the rope-in speeds.

3. Provides a limit to the voltage reference signals from the operator's hoist and drag master control to the hoist and drag voltage regulator under static or dynamic tightline conditions to reduce the speed of both towards zero velocity as the amount of combined hoist and drag rope-in length increases.

4. Operates contacts to alarm an operator of the equipment in the event the static or dynamic tightline boundaries are exceeded by a preset amount.

5. Operates contacts to remove both the hoist drum drive motor and the drag drum drive motor generator excitation to stop both drives if either the static or dynamic tightline boundaries are exceeded by a greater preset amount than that noted in item 4 above.

6. Operates contacts to alarm the operator in the event that the amount of hoist rope-in length or drag rope-in length reaches a preset maximum allowable value.

7. Operates contacts to remove hoist and drag drive motor generator excitation to stop both drive motors if the amount of hoist rope-in length or drag rope-in length reaches a preset critical value.

8. Provides an isolated power amplifier interface between the anti-tightline control module and older Amplistat (magnetic amplifier) type hoist and drag regulators to permit the same type of regulating and limiting action to the reference signal employed in operating the older Amplistat type hoist and drag regulator as that described in item 3 above for voltage reference signals applied to later model voltage output regulators utilizing operational amplifier circuits.

9. Provides a function generator to establish a specially shaped tightline boundary limit for use with those dragline type equipments whose tightline limits are not elliptical in nature.

10. Clamps the output regulating signal derived from the anti-tightline control module between a maximum value whereby full speed operation of the hoist and drag drives can be achieved and a minimum value which results in stopping the respective hoist and drag motion drives.

Figure 7A:
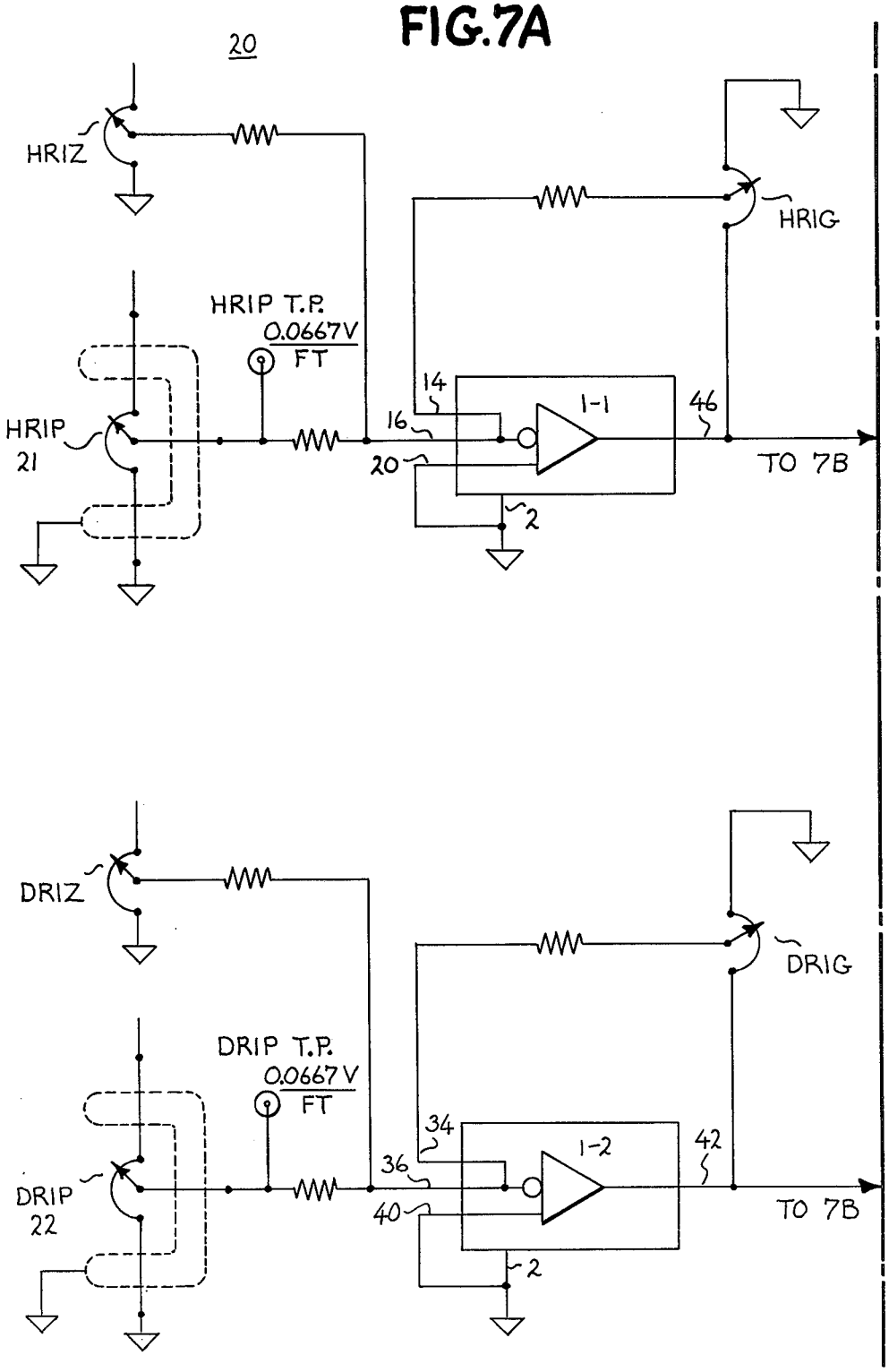
FIGS. 7, 7A, 7B, 7C and 7D comprise a detailed circuit diagram illustrating the essential constituent parts of the best mode for building an anti-tightline control system according to the invention known at the time of filing this application.

As shown in FIG. 7A the output from the hoist rope-in potentiometer (HRIP) 21 is supplied to one input terminal of an operational amplifier 1-1 to which a bias potential also is supplied from a hoist rope-in zeroing (HRIZ) potentiometer. The potentiometers HRIP and HRIZ are adjusted so that the potential appearing at test point HRIP T.P. amounts to 0.0667 volts for each foot of length of hoist rope taken-in onto the hoist rope drum. The operational amplifier 1-1 is a conventional, commercially available, operational amplifier having a hoist rope-in gain adjusting potentiometer HRIG connected to its feedback circuit for adjusting the gain of amplifier 1-1 to a value such that at test point HRI in the output of amplifier 1-1 an output voltage of 1 volt for each 15 feet of length of hoist rope-in is provided and 0 volts equals 0 length of hoist rope taken in on the hoist rope drum.

The drag rope-in potentiometer shown at 22 and also identified as DRIP is connected to an input terminal of a second operational amplifier 1-2 similar in construction to the operational amplifier 1-1 and also having supplied to its input the potential appearing across a drag rope-in zeroing potentiometer DRIZ. The feedback path of operational amplifier 1-2 includes a drag rope-in gain adjusting potentiometer DRIG for adjusting the gain of the amplifier such that at output test point DRI a potential is produced having a value of 1 volt for each 15 feet of drag rope-in and 0 volts equals 0 feet of drag rope taken-in on the drag rope drum. At test point DRIP on the input side of operational amplifier the voltage of 0.0667 volts per foot is produced for each foot of drag rope taken-in on the drag rope drum.

Figure 7B:
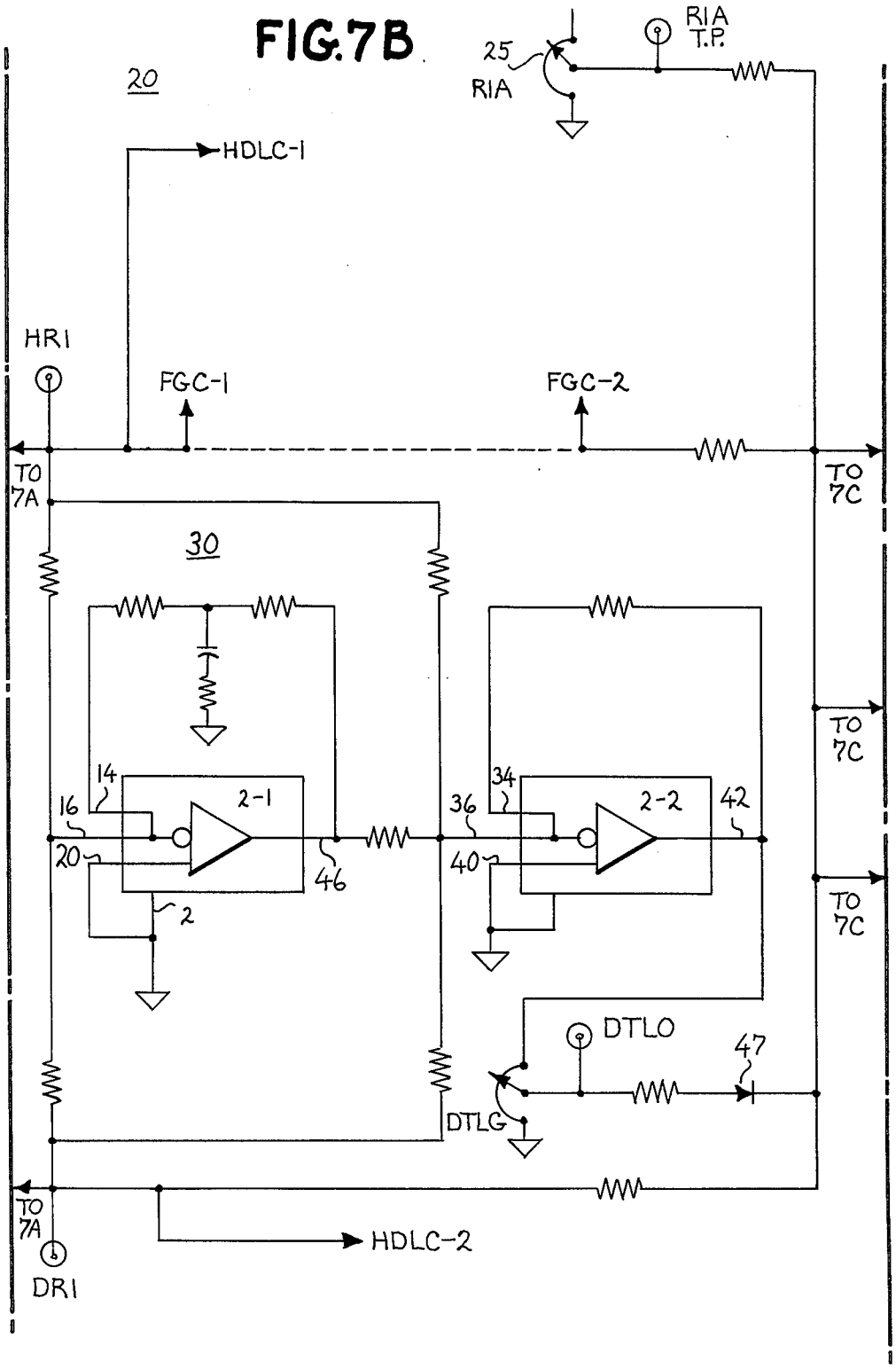
Figure 7C:
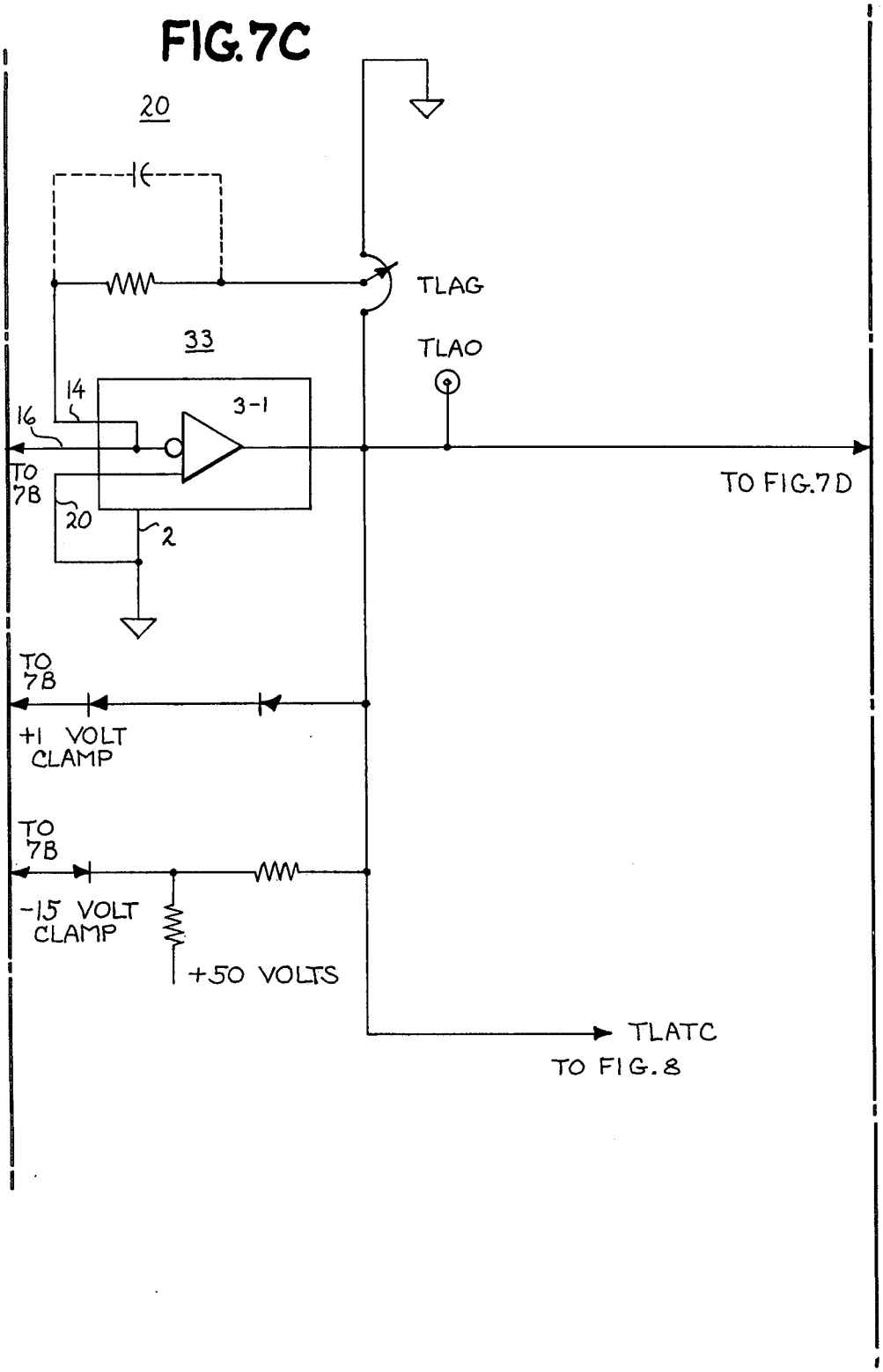

If the anti-tightline control system is intended for use with a dragline type equipment whose tightline boundary is elliptical in nature, the HRI output voltage appearing at test point HRI is supplied directly through a limiting resistor to one summing input of a summing amplifier 3-1 (33) shown in FIG. 7C. Such direct connection is indicated by the dashed line interconnecting test point HRI through a limmiting resistor shown in FIG. 7B to input terminal 16 of operational amplifier 3-1 shown in FIG. 7C. The drag rope-in output signal appearing at test point DRI also is supplied through a limiting resistor shown in FIG. 7B to the input terminal 16 of operational amplifier 3-1. A rope-in allowed bias signal derived from the rope-in allowed potentiometer 25 also identified as RIA shown in 7B is supplied also through a limiting resistor to input terminal 16 of amplifier 3-1 (33) for summation or comparison with the HRI and DRI input voltages.

In order to derive rope speed or rope velocity signals for use in establishing a dynamic tightline boundary under conditions where the hoist rope and/or drag rope are being moved, both the hoist rope-in length signal appearing at test point HRI and the drag rope-in length signal appearing at test point DRI are supplied through suitable limiting resistors to an input terminal 16 of an operational amplifier 2-1. Operational amplifier 2-1 has a differentiating network connected in its feedback path so that it functions as a differentiating circuit and derives at its output 46 a rope velocity or speed signal which is representative of the net hoist and drag rope speeds as discussed previously. This net speed signal is supplied through a further amplifier stage comprised by operational amplifier 2-2 having a dynamic tightline gain potentiometer DTLG connected to its output. The dynamic tightline output potential appearing across the wiper of potentiometer DTLG and at test point DTLO is supplied through an isolating diode 47 to the summing input terminal 16 of summing amplifier 33. This dynamic tightline output potential normally is positive in polarity for any net movement of the hoist and drag ropes in the take-up direction. The summing amplifier 33 is a conventional, commercially available operational amplifier having a tightline amplifier gain adjusting potentiometer TLAG connected in its feedback circuit for adjusting the gain of summing amplifier 3-1 to a value such that at test point TLAO an output signal of +1 volt provides so limiting regulating action on the operation of the dragline type equipment and an output potential of −15 volts provides maximum limiting. This output regulating potential then is supplied through an inverting amplifier 3-2 to an output amplifier 3-3 whose output TLMO is offset to a voltage of +15 v for no limiting action, and whose output reduces to approximately −1 v for maximum limitation. This output is in turn supplied through isolating diodes 48 to the hoist rope reference circuit 43 of the dragline type equipment hoist motion drive regulating system where a value of +15 volts provides maximum hoist rope speed reference. The TLMO output also is supplied through isolating diodes 49 to the drag reference circuit 44 of the dragline type equipment where a TLMO voltage value of +15 volts provides maximum drag reference.

Figures 7, 7D:
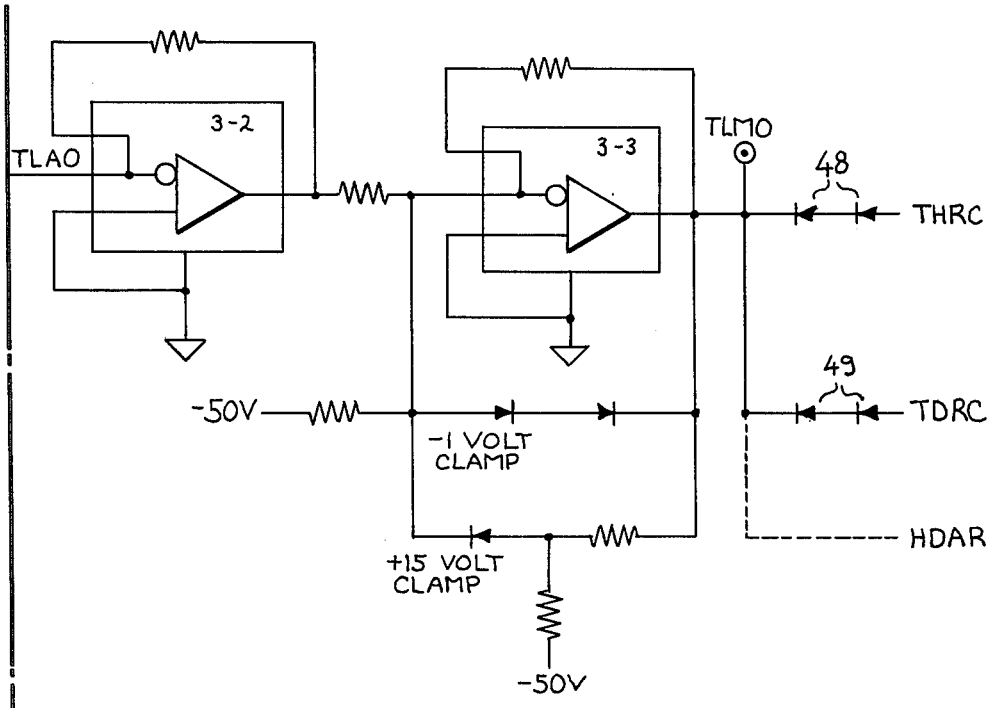
Figure 8:
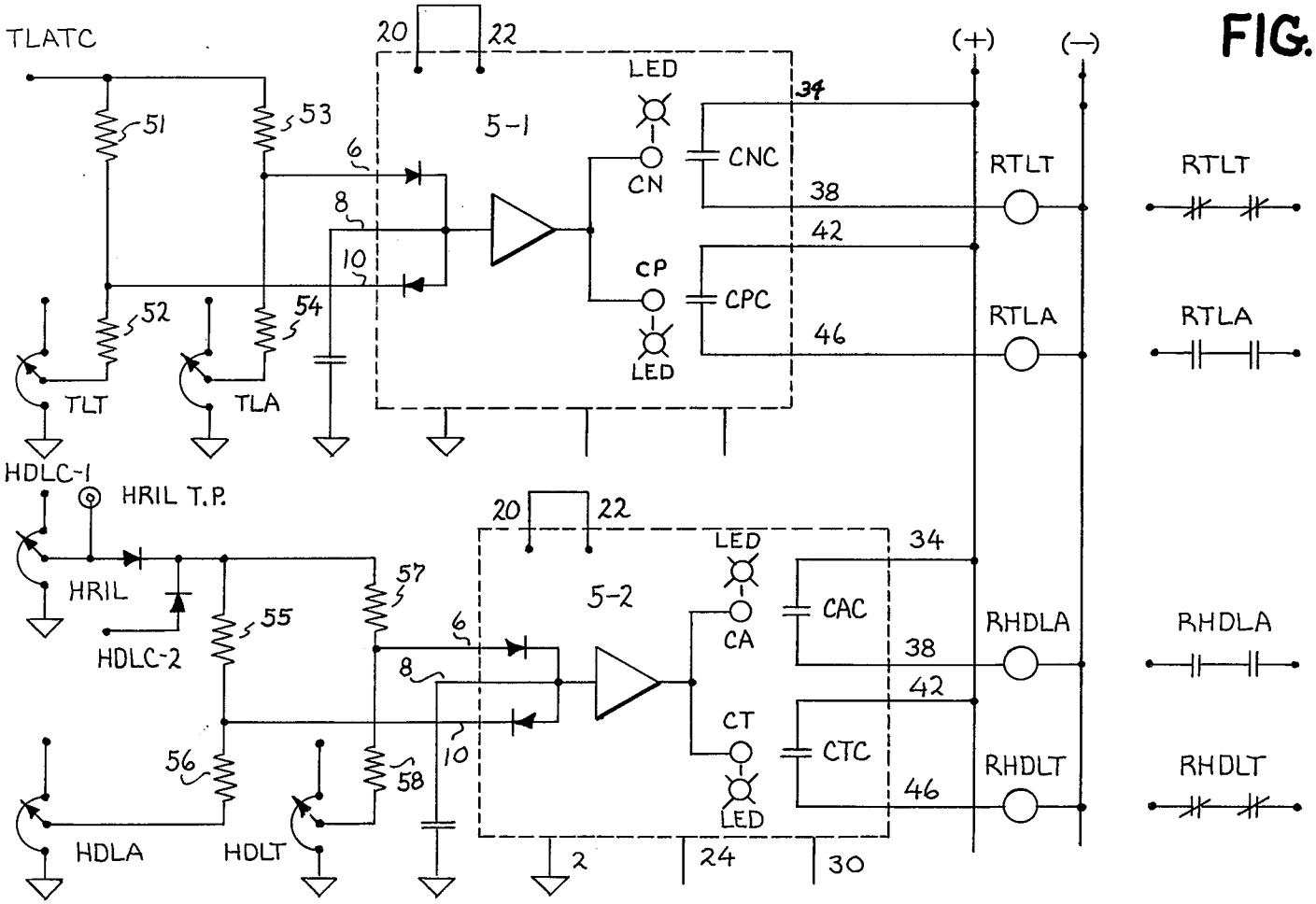
FIG. 8 is a detailed circuit diagram of a tightline alarm and trip circuit and a hoist and drag limit alarm and trip circuit employed in conjunction with the anti-tightline control system of FIGS. 7 through 7C.

FIG. 8 is a detailed circuit diagram of the tightline alarm and trip circuit and a hoist and drag limit alarm and trip circuit which is coupled to the tightline control circuit shown in FIG. 7 of the drawings. At the upper left corner of FIG. 8, a terminal TLATC has supplied thereto the tightline control circuit output signal appearing at test point TLAO at the output of summing amplifier 3-1 in FIG. 7. This output tightline control signal is applied across a bridge network comprised of resistors 51 and 52 connected in series with a trip limit setting potentiometer TLT and resistors 53 and 54 connected in series with an alarm limit setting potentiometer TLA. The junction of resistors 51 and 52 and the junction of resistors 53 and 54 are connected through isolating diodes to an input terminal of an output amplifier 5-1 of conventional, integrated circuit construction. The output of amplifier 5-1 is connected to actuate the solenoid windings of a pilot relay CP whose contacts CPC serve to connect the solenoid winding of a relay RTLA across a 125 volt DC power supply. The normally closed contacts or relay RTLA in turn serve to actuate an alarm on the operator's control panel. The output of amplifier 5-1 also, upon exceeding the limit value established by the TLT potentiometer actuates the solenoid windings of a pilot relay CP whose normally open contacts CPC then close the solenoid winding of the relay RTLT across the DC power supply terminal. Actuation of relay RTLT then serves to close the normally open contact RTLT of the tightline limit trip circuit included in the power supply to the hoist and drag motion regulations.

The hoist and drag limit alarm and trip circuit as shown in FIG. 8 is comprised by a hoist rope-in limit circuit having one of its input terminals HDLC-1 connected to the corresponding HDLC terminal appearing in the middle at the top of FIG. 7B of the drawings. This terminal HDLC-1 has supplied to it the hoist rope-in length signal appearing at test point HRI. The drag rope-in length signal appearing at test point DRI in FIG. 7B is supplied through terminal point HDLC-2 such that the hoist rope-in and drag rope-in length signal are supplied through isolating diodes across a resistor bridge comprised by resistors 55, 56, 57 and 58. Resistors 55 and 56 are connected in series circuit relationship with a potentiometer HDLA for setting the hoist and drag rope length alarm limit. The resistors 57 and 58 are connected in series circuit relationship with a potentiometer HDLT for setting the hoist and drag rope length limit trip. The junctures of resistors 55 and 56 and the juncture of resistors 57 and 58 are connected through respective isolating diodes to an input of an output amplifier 5-2 similar in construction to the amplifier 5-1 described previously. Amplifier 5-2 has its output connected to the winding of a pilot relay CA whose normally open contacts CAC upon deenergization of pilot relay CA serve to open the windings of a relay RHDLA across the DC power supply terminals. Deenergization of the windings of RHDLA functions to open the normally open contact of a hoist and drag rope length limit alarm mounted on the operator's control panel. In the event that the output of amplifier 5-2 exceeds the alarm limit by some predetermined amount, the windings of a second pilot relay CT will be energized and will close its normally open contacts CTC to thereby connect the windings of a relay RHDLT across the DC power supply. This in turn results in opening the normally closed contacts RHDLT of a hoist drag limit trip circuit to deenergize the hoist and drag generator fields. It should be noted that each of the pilot relays CA and CT in the hoist and drag limit alarm and trip circuit and the pilot relays CN and CP in the tightline alarm and trip circuit upon deenergization light up small warning light emitting diodes (LEDs) as a backup indication that the limits established by the respective circuits have been exceeded. These LEDs also are useful in the preliminary alignment of the circuitry as will be described more fully hereafter.

Figure 9:
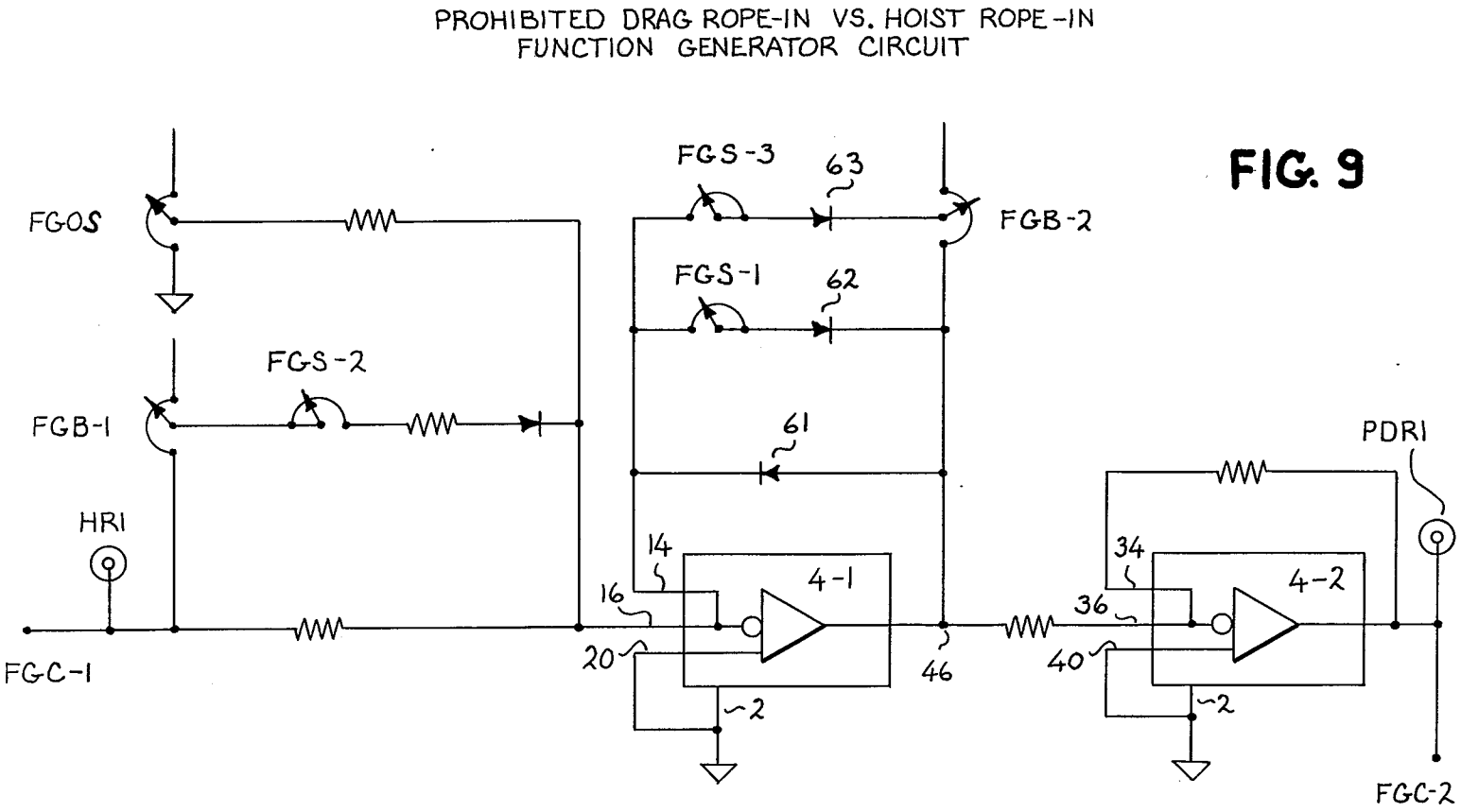
FIG. 9 is a detailed circuit diagram of a function generator circuit employed in connection with the circuit of FIGS. 7–7D for use with certain specialized types of dragline equipment whose tightlining characteristics are non-elliptic in nature.

As described earlier with reference to FIG. 5 of the drawings, there are certain types of dragline equipment which do not possess an elliptical tightline limit boundary. FIG. 9 is a detailed circuit diagram of a suitable function generator which provides a capability to set a tightline limit boundary characteristic with up to three different slopes, if required, for use with any such equipment. The circuit shown in FIG. 9 of the drawings is designed to provide a prohibited drag rope-in length output signal PDRI in response to an input hoist rope-in length input signal HRI. As best seen in FIG. 7B, if the dragline type equipment requires a function generator circuit due to the fact that it is either necessary or otherwise desirable to provide a tightline limit boundary characteristic which is nonelliptical in nature, then in place of the direct connection between the terminal points FGC-1 and FGC-2 shown by the dotted line jumper connector in FIG. 7B, a function generator circuit such as shown in FIG. 9 would be inserted.

FIG. 9 function generator circuit is comprised of a first stage operational amplifier 4-1 of discrete component or integrated circuit construction having the hoist rope-in length input signal HRI applied to an input terminal 16 via the input terminal point FGC-1. The HRI input signal is supplied to input terminal 16 through an input circuit comprised by a limiting resistor connected in parallel with an adjusting network comprised by a function generator break point #1 potentiometer FGB-1 having its wiper arm connected to the wiper arm of a function generator slope #2 potentiometer FGS-2 and a limiting resistor and diode to the input terminal 16. In addition, a function generator offset potentiometer FGOS has its wiper arm connected through a limiting resistor to the input terminal 16. The output terminal 46 of operational amplifier 4-1 is connected back to the input terminal 16 via feedback network comprised by a diode 61 in one branch, a diode 62 and function generator slope setting potentiometer FGS-1 connected in series with diode 62 in a second branch circuit that is connected in parallel with diode 61. A third branch network comprised by a potentiometer FGB-2, a diode 63 and potentiometer FGS-3 all connected in series circuit relationship with the series circuit thus formed being connected in parallel with diode 61 and the branch network comprised by diode 62 and potentiometer FGS-1. The output of the function generator circuit thus comprised is supplied through a limiting resistor to the input of an output operational amplifier 4-2 which derives at its output the desired prohibited drag rope-in length signal PDRI for use in the tightline control circuit of FIG. 7 in place of the hoist rope-in length signal HRI. The PDRI signal is introduced into the control system of FIG. 7B at terminal point FGC-2.

Figure 9A:
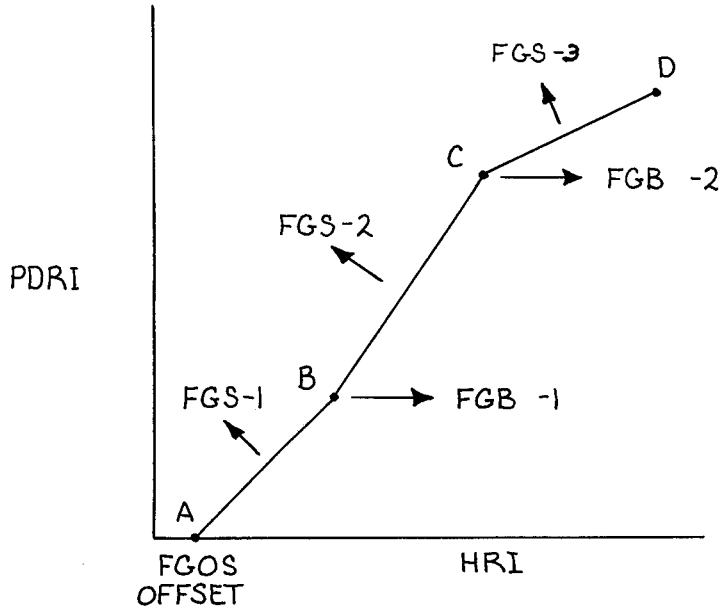
FIG. 9A is a specialized tightlining characteristic curve of an exemplary dragline type equipment which could be built into the transfer function of the function generator shown in FIG. 9 for deriving a permitted drag rope-in output signal for a given value hoist rope input signal.

FIG. 9A of the drawings is a typical operating characteristic curve for the function generator circuit shown in FIG. 9. In FIG. 9A the hoist rope-in length signal HRI is plotted as the abcissa and the prohibited drag rope-in length signal PDRI is plotted as the ordinate. In this exemplary characteristic curve, it is assumed that the hoist rope will have a typical maximum length of 375 feet which value would be represented by a potential of 25 volts. Zero volts would represent 0 length hoist rope-in on the hoist drum. For the PDRI ordinate, a typical drag rope maximum length-in would be 300 feet corresponding to a maximum voltage of 20 volts where 0 volts would represent 0 drag rope length-in. The manner in which the various potentiometers FGS1, FGB1, FGS2, etc., would be adjusted to provide the operating characteristic curve of FIG. 9A will be described more fully hereinafter.

Figure 10:
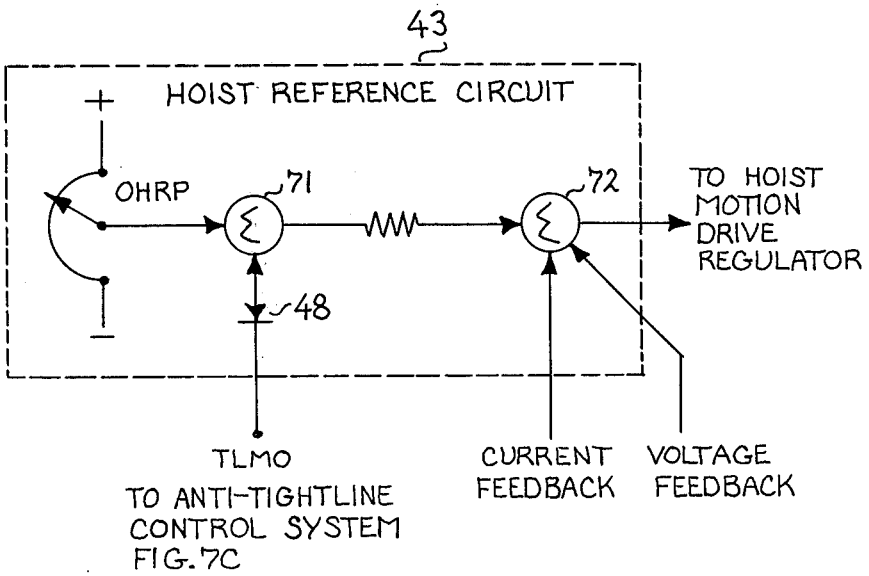
FIG. 10 is a schematic circuit diagram illustrating one form of operator motion control reference circuit useable with the anti-tightline control system provided by the invention.

As best seen in the upper righthand corner of FIG. 7D, the control regulating output signal TLMO produced at the output of output amplifier is supplied through isolating diode 48 for application to the hoist reference circuit and through isolating diode 49 for application to the drag reference circuit. Since the hoist reference circuit and drag reference circuit are similar in construction and operation, for convenience only the hoist reference circuit will be described in detail. Referring to FIG. 10, the TLMO output from the output amplifier of FIG. 7D is applied through isolating diode 48 to a summing junction 71 together with an operator set hoist reference potential derived from a potentiometer OHRP that is manually operated by the dragline equipment operator. Summing junction 71 combines the two potentials to derive a controlling output reference potential that is supplied over a limiting resistor as one input to a second summing junction 72. The second summing junction 72 combines this controlling combined operator set hoist reference potential and tightline amplifier output reference potential with a current feedback signal and voltage feedback signal in the second summing circuit 72 to derive at the output of summing circuit 72 a hoist motion drive regulator controlling signal. The current/voltage feedback signals are derived from generator motor drive systems which control operation of the hoist drum as explained with relation to FIG. 6 and the output signal from summing circuit 72 is applied to the hoist motion drive regulator 38 of FIG. 6. As noted above, the drag motion drive regulation is achieved in a similar manner.

Figure 11:
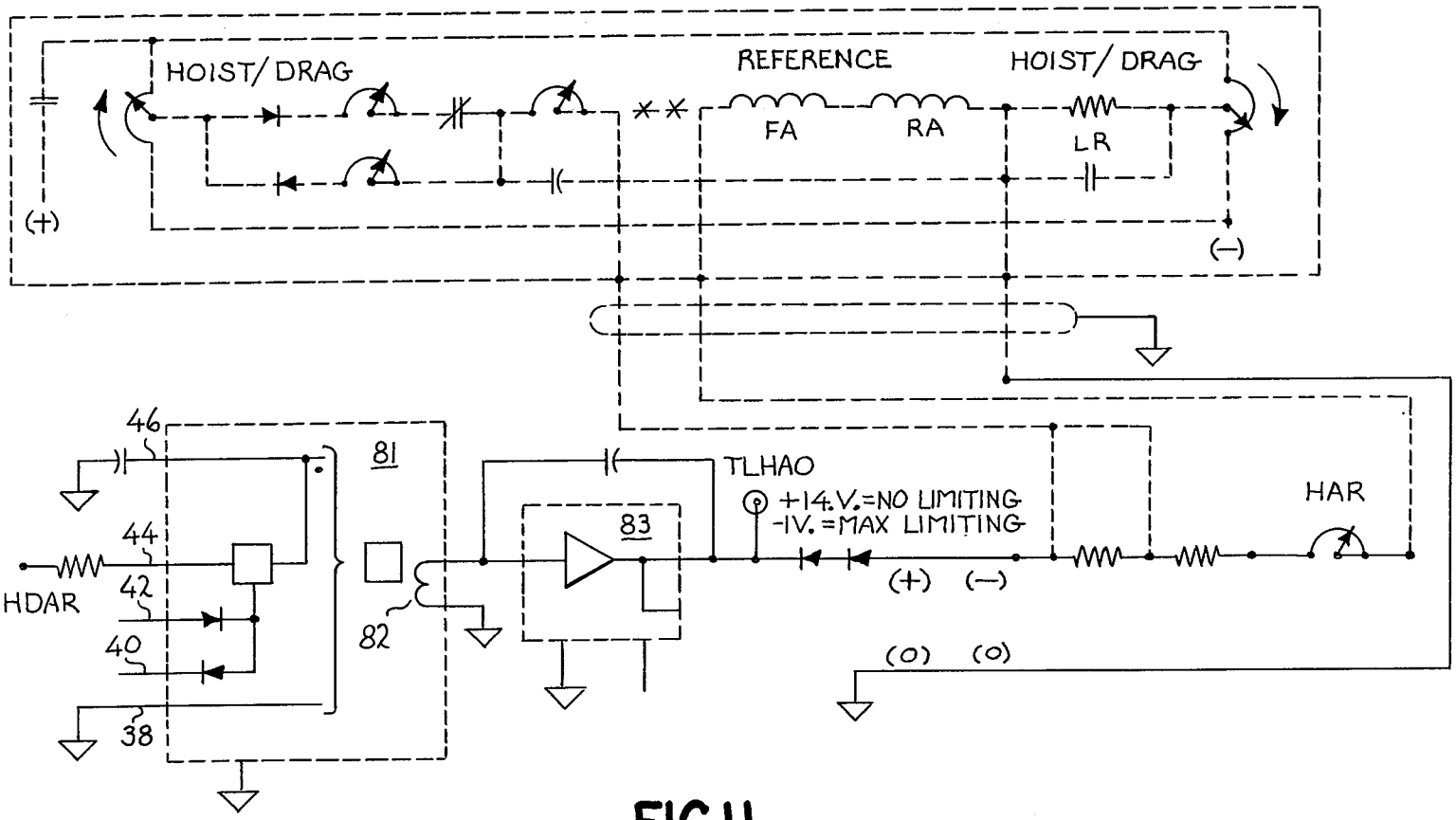
FIG. 11 is a detailed circuit diagram of a conversion circuit for converting the output signal from the anti-tightline control system of FIGS. 7–7C into a different, current signal form useable with Amplistat (magnetic amplifier) type regulators employed on many older dragline type equipments.

FIG. 11 is a detailed circuit diagram of an alternative form of reference circuit for use in connection with the anti-tightline control system according to the invention. The reference circuit shown in FIG. 11 is intended for use with older type Amplistat (magnetic amplifier) regulators used in certain older dragline type equipment. These Amplistat regulators are what is known in the art as magnetic amplifiers and generally function in response to input current controlling signals. The primary purpose of the reference circuit shown in FIG. 11 is to convert the form of the input TLMO output signal from the output amplifier of FIG. 7D applied through terminal HDAR from a voltage controlling signal to a corresponding current controlling signal. For this purpose the input TLMO regulating control signal is supplied to the input of an isolated power amplifier circuit shown generally at 81 and which is of conventional, commercially available integrated circuit construction but which includes an output transformer for isolation purposes having an output secondary winding shown at 82. The output controlling signal appearing across secondary winding 82 is supplied to a second stage, integrated circuit power amplifier 83 with the two power amplifier stages 81 and 83 being designed to provide unity gain. Thus the output from the second state isolated power amplifier 83 appearing at test point TLHAO corresponds in voltage value to the input TLAO signal from summing amplifier 33 wherein the control signal value of +14 volts provides no limiting action on the hoist or drag regulator and an input voltage value of −1 volt provides maximum limiting. This power amplifier control regulating signal then is supplied to the conventional Amplistat regulator control reference circuit which includes the potentiometer HAR for providing a hoist Amplistat reference input signal to the Amplistat reference windings FA and RA. The input TLHAO tightline control signal is subtracted from the hoist Amplistat reference signal to thereby control the regulating operation of the Amplistat. Since the drag reference circuit for the drag Amplistat regulator is similar in construction and operation to the hoist reference circuit and would be supplied with the same input signal from terminal HDAR, for convenience, the drag reference circuit for the Amplistat type regulator has not been illustrated or described.

Having described briefly the construction of the best mode of practicing the anti-tightline control method and system of the invention with respect to FIGS. 7–11 of the drawings, initial setup and alignment of the system to make it operational is as follows. Previously, however, the desired static and dynamic tightline boundaries under the boom for the particular dragline type equipment have to be determined in order to provide a necessary hoist and drag regulator reference reduction, alarm and trip and the hoist and drag limits of travel for alarm and trip. These must be determined by the machine builder or owner and the installer. With this information in hand after the control system is installed and all connections made, the hoist rope-in length potentiometer HRIP of FIG. 7A is first aligned. This is achieved as follows:

(1.1) Operate the hoist drive to position the bucket the desired minimum distance from the boom point sheave. For example, assume this distance is 50 ft. Note the rotation of the hoist rope in pot HRIP shaft as the rope is being reeled in.

(1.2) Loosen the coupling and rotate the pot shaft in the same direction that it was rotating while rope was being reeled in. Rotate the pot shaft to its full travel limit, usually indicated by two detents being felt, then back off to the first detent, which is the maximum rope-in position of the pot. Tighten the coupling.

(1.3) Determine the amount of rope-out remaining between the bucket and the boom tip, and divide this number of feet by 15 ft/volt. The result is the number of volts that the voltage at hoist rope-in test point HRI must be reduced by adjusting hoist rope-in zero pot HRIZ after the hoist rope-in gain pot HRIG has been adjusted for 1 volt/15 ft. in the next step. For this example, 50 feet divided by 15 ft/volt equals 3.33 V.

(1.4) Determine the drum wrap constant (i.e., the circumference of the drum in feet). For this example assume a 10 ft. diameter drum which would have a drum wrap constant of approximately 3.14×10 ft.=31.4 ft. Therefore, three turns of the drum would represent 94.2 feet of rope. Make a chalk mark on the drum so that it is possible to accurately determine when exactly three turns of the drum have been made, clockwise or counter-clockwise.

(1.5) Apply control power to the anti-tightline module to prepare for setting the hoist rope-in gain pot for 1 volt/15 ft. Setting the gain pot will require several iterations of the following procedure. Set the hoist rope-in zero pot HRIP full counter-clockwise for no output voltage. Make a first reading of the voltage at hoist rope-in test point HRI. Then rotate the drum three turns, which corresponds to a change in rope of 3×the drum wrap constant. (For this example, three turns represents 31.4 ft.). Then make a second reading of the voltage at hoist rope-in test point HRI. For rope-in rotation, the second reading will be higher, while for rope-out rotation, the second reading will be lower. (For this example, the required change in voltage is 31.4 ft./15 ft/v=2.09 V.) Adjust gain pot HRIG clockwise if the difference is too low, or counter-clockwise if the difference is too high. Repeat this procedure until the gain is correctly set for 1 volt change at HRI for a 15 ft. change in the amount of rope on the drum.

(1.6) To set the hoist rope-in zero pot HRIZ, refer to the number calculated in step (1.3) (for this example, 3.33 V). Next, read the voltage at the hoist rope-in test point HRI. Subtract from this number the number calculated in step (1.2). Then adjust the HRIZ pot clockwise until the voltage at test point HRI is reduced to the number calculated above. The hoist rope-in circuits are now set to provide the same effective calibration that would be obtained by hoisting the bucket up against the boom point sheave and mechanically setting the hoist rope-in pot HRIP to its full travel detent position for maximum hoist rope-in.

NOTE: The HRIP pot resistance is distributed over approximately 340° of mechanical rotation. The pot is typically geared for 0.8° rotation per foot of rope. For a typical active hoist rope length of 400 ft., the rheostat will rotate through 400 ft.×0.8°/ft=320°. Since the full electrical span across the total 340° of the pot is 50 V, the voltage span for 400 ft. of rope=320°/340°×50 V=47 V measured at hoist rope-in pot test point HRIP. Since the required electrical span at hoist rope-in test point HRI=400 ft/15/ft/V=26.7 V. Therefore, the gain setting of the HRIG pot for this example would be 26.7/47=0.57 V/V. The voltage at the hoist rope-in test point HRI, if all 400 ft. of rope were reeled in, would be 26.7 V. With 350 feet of hoist rope-in (the bucket positioned 50 ft. below the boom point sheave), the voltage at HRI would be 23.3 V.

The next step is to adjust the drag rope-in potentiometer DRIP. In the example being explained, this is achieved as follows:

(2.1) Operate the drag drive to position the bucket the desired minimum distance from the fair leads. For this example, assume this distance is 50 ft. Note the rotation of the drag rope-in pot DRIP shaft as rope is being reeled in.

(2.2) Loosen the coupling and rotate the pot shaft in the same direction that it was rotating while rope was being reeled in. Rotate the pot shaft to its full travel limit, usually indicated by two detents being felt, and then back off to the first detent, which is the maximum rope-in position of the pot. Tighten the coupling.

(2.3) Determine the amount of rope-out between the bucket and the fair leads, and divide this number of feet by 15 ft/volt. The result is the number of volts that the voltage at drag rope-in test point DRI must be reduced by adjusting drag rope-in zero pot DRIZ after the drag rope-in gain pot DRIG has been adjusted for 1 volt/15 ft in the next step. For this example, 50 ft. divided by 15 ft/volt equals 3.33 V.

(2.4) The drum wrap constant for the drag drum should be the same as that calculated for the hoist drum in step (1.4). For this example, assume three turns of the drum would represent 94.2 ft. of rope.

(2.5) Apply control power to the anti-tightline module to prepare for setting the drag rope-in gain pot for 1 volt/ft. Setting the gain pot will require several iterations of the same procedure detailed in step (1.5). Adjust the drag rope-in gain pot DRIG for 1 volt change at DRI for a 15 ft. change in the amount of rope on the drum.

(2.6) To set the drag rope-in zero pot DRIZ, refer to the procedure detailed in step (1.6). The drag rope-in circuits are now set to provide the same effective calibration that would be obtained by dragging the bucket in against the fair leads and setting the drag rope-in pot drip to its full travel detent position for maximum drag rope-in.

Note: The DRIP pot resistance is distributed over approximately 340° of mechanical rotation. The pot is typically geared for 0.8° rotation per foot of rope. For a typical active drag rope length of 300 ft., the rheostat will rotate through 300 vt.×0.8°/ft−240°. Since the full electrical span across the total 340° of the pot is 50 V, the voltage span for 300 ft. of rope—240°/340°×50 V=35.3 V measured at the drag rope-in pot test point drip. Since the required electrical span at drag rope-in test point DRI=300 ft/15/ft/V=20 V. Therefore, the gain setting of the DRIG pot for this example would be 20/35.3=0.57 V/V. The voltage at the drag rope-in test point DRI, if all 300 ft. of rope were reeled in, would be 20 V. With 250 ft. of drag rope-in (the bucket positioned 50 ft. ahead of the fair leads), the voltage at DRI would be 16.7 V.

Where the anti-tightline control system is being employed in conjunction with dragline equipment requiring an elliptical tightline boundary under the boom, the sum of maximum allowable hoist rope-in plus drag rope-in is a constant. Accordingly, a preset bias voltage can be used to establish the maximum value for the combined sum of hoist rope-in plus drag rope-in before the anti-tightline control begins to take over and reduce the hoist and drag regulator reference signal value established by an operator of the equipment. Therefore, each foot of hoist rope-in effectively reduces the maximum allowable drag rope-in by 1 foot for any position of the bucket under the boom. With dragline type equipment having an elliptical tightline boundary under the boom, the function generator circuit shown in FIG. 9 is not required and accordingly the hoist rope-in voltage value appearing at test point HRI of FIG. 7 is supplied directly through a limiting resistor to the input terminal 16 of the summing amplifier 3-1 (33).

It next is necessary to determine the number of feet of hoist and drag rope-in at 2 points under the boom on the tightline boundary. The first point to be determined is the point where the tightline limit should begin to limit the maximum reference value supplied to the hoist and drag regulator circuits. The second point is where the tightline limit should reduce the reference to both regulators to zero thereby effectively stopping further hoist and drag rope take-up. For example, assume that under the boom near the mid-point that 250 feet each of hoist rope-in plus drag rope-in defines a point on the tightline boundary where the tightline limit should begin and that 30 feet more of net hoist rope-in should result in the production of a zero reference signal to both hoist and drag motion regulators to stop both drives. For this assumed example, the voltage at test points HRI and DRI, where tightline limiting action begins to take over, would be approximately +16.67 volts DC at each of the test points. If the voltage at either test point is increased by +2 volts DC to a value of +18.67 volts, the reference signals to both hoist and drag motion regulators then would be reduced to zero value and further hoist or drag motion in the take-up direction would be stopped.

With the assumed values of voltages noted above where anti-tightlining control takes over and thereafter reduces the reference to zero value, and using separate input test potentiometers, input voltages should be supplied to the test points HRI and DRI, respectively, which test input voltages have values where the tightline limit takeover begins. The rope-in allowed potentiometer RIA (also noted as potentiometer 25) should then be set to a voltage of 0 volts DC at the output of the tightline summing amplifier output test point TLAO. The input voltage test point HRI should then be increased to a value where the tightline limit control has a value to fully stop the hoist and drag drives. At this point, the tightline amplifier gain potentiometer TLAG should be set to provide a voltage of approximately −15 volt DC at the output test point TLAO. The output of the output amplifier TLMO will be +14 V when limiting action begins, and will reduce to −1 V when maximum limiting action fully stops the hoist and drag drives.

With the anti-tightline control module partially aligned as described above, the dynamic tightline differentiator circuit 30 then should be aligned. The dynamic tightline differentiator circuit 30 algebraically sums the hoist rope-in signal HRI with the drag rope-in signal DRI, and, through a differentiator network, develops a dynamic tightline signal proportional to the velocity of the net rope-in. For an increasing net rope-in condition, the signal from the differentiator circuit is of the same positive polarity as the static hoist and drag rope-in signals, and thereby produces a dynamic tightline boundary that is located further away from the boom than the initially set static tightline boundary. To adjust the differentiator circuit gain, a test signal generator output should be supplied to the test point HRI with the test signal generator adjusted to provide a ramp voltage of +1 volt per second which is equivalent to a net rope-in rate of 15 feet per second. With this test signal input adjust the dynamic tightline gain potentiometer DTLG to provide a voltage of +5 volts DC at the dynamic tightline limit output test point DTLO. This results in a dynamic tightline boundary of 75 feet of net rope-in further from the boom than the static tightline boundary under conditions where the net rope-in is increasing at a rate of 15 feet per second.

At this point in the alignment procedure it is necessary to establish the tightline alarm and trip limit levels.

For this purpose it is necessary to determine in advance the number of feet of hoist and drag rope-in where the tightline alarm and trip should occur. For example, assume that the tightline alarm setting should coincide with the setting for the tightline limit takeover and that the tightline trip setting should occur at 28 feet of additional net rope-in, equivalent to an additional +1.9 volts DC of rope-in signal. To accomplish this setting a test signal of +16.7 volts DC should be applied as an input to test point DRI. Thereafter adjust the tightline alarm potentiometer TLA shown in FIG. 8 until the top light emitting diode associated with pilot relay winding CN test comes on to indicate that the tightline alarm relay RTLA has dropped out. This sets the alarm at the net rope-in value where tightline limit just begins to take over and limits further hoist and drag reference input in the take-up direction. Thereafter, a similar +16.7 volt DC signal should be applied at test point DRI and the voltage applied to test point HRI increased to +18.6 volts DC. With the input voltages thus adjusted, the tightline trip potentiometer TLT should be adjusted until the bottom light emitting diode associated with the pilot relay CP just goes off thereby indicating that the tightline trip relay TLT has picked up. This sets the trip value at the desired differential distance of rope-in after the alarm has been actuated.

In order to align the hoist and drag limit alarm and trip circuit the test input voltage supplied to test point HRI is then increased to a value (typically +26.7 volts DC=400 feet of hoist rope-in) corresponding to the maximum amount of hoist rope-in where the hoist limit trip is to occur. With this input test voltage value applied at test point HRI, the hoist rope-in limit potentiometer HRIL is adjusted to produce a voltage at test point HRIL corresponding to the drag rope-in voltage DRI where drag limit trip is to occur (typically +20 volts DC). This scales the hoist rope-in limit signal to equal the drag rope-in limit signal in order to use a common alarm and trip circuit. Thereafter the hoist/-drag trip potentiometer is adjusted until the top light emitting diode associated with pilot relay CA just goes out to indicate that the hoist/drag limit trip relay RHDLT has dropped out. With the trip limit set, the input to the DRI test point is reduced to a +20 volt DC value and the input test signal at test point HRI so that the voltage at test point HRIL is reduced by approximately 15% to a value of +17 volts DC for example. With these input test voltage values, the hoist/drag alarm potentiometer HDLA is adjusted until the bottom light emitting diode associated with pilot relay CA comes on to indicate that the hoist/drag alarm relay RHDLA has just picked up. Finally, with a reduced input test signal of +17 volts DC applied to the DRI test point the same steps recited above then are repeated with an input to test point DRI of +20 volts DC and +17 volts DC, respectively. The typical test point voltage values and settings described above will call for a hoist and drum limit trip at +30 volts DC at test point HRIL corresponding to 400 feet of hoist rope-in and +20 volts DC at DRI corresponding to 300 feet of drag rope-in. The settings also will call for alarm at +17 volts DC at HRIL corresponding to 340 feet of hoist rope-in and +17 volts DC at test point DRI corresponding to 255 feet of drag rope-in.

For those dragline type equipments requiring a prohibited drag rope-in versus hoist rope-in function generator such as that shown in FIG. 8, the equipment manufacturer or owner of the equipment must supply to the installer a tightline boundary characteristic for the equipment which may be similar to that illustrated in FIG. 9A, for example. With such equipment, the relationship of the net hoist and drag rope-in allowed, is not a constant. With such equipment, the desired tightline boundary under the boom must be established and the characteristic for prohibited drag rope-in versus hoist rope-in must be determined. With this information at hand, a test voltage input from a test signal generator or potentiometer provides input voltages at test point HRI. The procedure for setting the typical function generator characteristic curve illustrated in FIG. 9A thereafter is set forth in the following table. The settings are typical numbers intended only for explanatory purposes and would result in a function generator operating characteristic similar to that shown in FIG. 9A. Before starting the procedures depicted in the below table, the function generator offset potentiometer FGOS and the function generator slope potentiometers FGS1, FGS2 and FGS3 all should be turned to their full counterclockwise position. The function generator break-point potentiometers FGB1 and FGB2 both should be turned to their full clockwise position. The circuit then is ready for alignment as depicted below in the following table.

| HRI | PDRI | POT ADJUSTED | SETTING |
|---|---|---|---|
| +2.5 VDC | 0 VDC | FGOS | OFFSET A |
| +10 | +7.5 | FGS1 | SLOPE A-B |
| +10 | +7.5 | FGB1 | BREAK POINT B |
| +15 | +15 | FGS2 | SLOPE B-C |
| +15 | +15 | FGB2 | BREAK POINT C |
| +25 | +25 | FGS3 | SLOPE C-D |

After establishing the exemplary voltage values at the test points noted in the above table by adjustment of the indicated potentiometers, the entire function generator characteristic output should be rechecked by taking enough voltage readings at test points HRI and PDRI to plot the operating characteristic curve of the function generator and confirm that it matches the desired prohibited drag rope-in versus hoist rope-in characteristic for the drag-line type equipment in question.

The reference circuit adjustment for the reference circuit shown in FIG. 10 of the drawings automatically will be accomplished by alignment of the anti-tightline control system described with relation to the adjustment of the rope-in allowed and tightline amplifier gain adjustment described earlier. However, with relation to the reference circuit shown in FIG. 11, it is necessary to make certain additional adjustments by inserting one or two resistors as required in series with the hoist Amplistate reference rheostat HAR shown in FIG. 11 and the corresponding drag Amplistat reference rheostat DAR (also on the same module but not shown in FIG. 11) in order to achieve a +15 volt DC signal across the series connected resistors, the rheostat and the Amplistat reference windings of each of the hoist or drag Amplistat regulator reference circuits under conditions where the hoist and drag master controls call for maximum generator volts for the respective hoist and drag motion motor generator drive systems. It should be noted that the resistance in the existing Amplistat regulator reference circuit rheostat must be reduced by exactly the resistance added in the module in order to reestablish the correct reference winding current for maximum generator voltage in the drive regulators. Since the voltage gain for the isolator circuit 81 and the power amplifier 83 in the circuit of FIG. 11 is unity, exactly the same setup procedure detailed previously can be used for the Amplistat regulators as well as the voltage control regulators, since reducing the reference voltage for either type of regulator from a value of +15 volts DC to 0 volts effectively reduces the associated drive regulator generator voltage from a maximum value to zero output.

From the foregoing description it will be appreciated that the novel anti-tightline control system and method provided by the invention monitors the hoist and drag rope-in lengths of dragline type equipment, and in the event that certain preset levels are exceeded, functions to slow the hoist and drag drives, initiates a warning to the operator, and, if required, stops the hoist and drag drives. To accomplish this, the system compares the total amount of hoist and drag rope-in against a preset value of rope-in allowed to establish an elliptical tightline boundary under the boom of the dragline type equipment. The system also differentiates the rate of change of net rope-in to provide a dynamic tightline boundary further from the boom under those conditions where either hoist or drag rope or both are being taken-up (hoisted or dragged in). The system operates contacts to alarm the operator when the static or dynamic tightline boundary established by the preset levels are exceeded by a preset amount and operates additional contacts to remove hoist and drag motion drive generator excitation to stop both hoist and drag drives if the boundaries are exceeded by a greater preset amount. The system also, as an added feature, operates contacts to alarm the operator of the equipment when the amount of hoist rope-in or drag rope-in reaches a preset maximum allowable value, and operates additional contacts to remove hoist and drag generator excitation to stop both hoist and drag drives if the amount of hoist rope-in or drag rope-in reaches a different preset critical value. Most importantly, the anti-tightline control circuit operates to limit the value of the voltage reference signals supplied from the operator's hoist and drag master control to the hoist and drag motion voltage regulators under either static or dynamic tightline conditions to reduce the speed of both the hoist and drag drives towards zero as the net amount of rope-in increases. For those special dragline type equipments having specially-shaped tightline limit boundaries, the invention makes available a function generator circuit to establish a specially-shaped tightline boundary and derive an output allowed rope-in signal for use in the regulating and controlling actions of the dragline type equipment as described previously. Finally, the invention makes available different types of reference circuits for interfacing with older types of dragline equipment such as those using magnetic amplifier Amplistat hoist and drag regulators for providing anti-tightline control over the operation of such equipments.

Having described several embodiments of a novel anti-tightline control system and method according to the invention, it is believed obvious that other modifications, variations and changes in the embodiments disclosed will become apparent to those skilled in the art in the light of the above teachings. It is therefore to be understood that changes may be made in the particular embodiments of the invention described which are within the full intended scope of the invention as defined by the appended claims.

What is claimed is:

1. An anti-tightline control system for dragline type equipment having respective hoist and drag rope means that can be paid-out or taken-up by operator controlled respective hoist rope and drag rope pay-out and take-up means to control positioning and operation of a dragline bucket means, said anti-tightline control system comprising hoist rope position encoding means for deriving electric hoist rope position signals representative of the length of hoist rope means paid-out or taken up by said hoist rope pay-out and take-up means at any given time, drag rope position encoding means for deriving electric drag rope position signals representative of the length of drag rope means paid-out or taken-up by said drag rope pay-out and take-up means at any given time, means for separately developing a maximum hoist and drag rope length allowed-in bias signal representative of the maximum length of hoist and drag rope allowed to be taken-up and still avoid a tightline condition if the hoist and drag rope velocities are near zero, a first summing circuit means responsive to the outputs from said hoist rope and drag rope position encoding means and said maximum hoist and drag rope-in allowed bias signal, said first summing circuit means serving to sum together the hoist rope and drag rope positions signals with the maximum hoist and drag rope length allowed-in bias signal and to derive an output difference allowed hoist and drag rope length static anti-tightline boundary limited control signal that is useful for regulating and controlling operation of the hoist rope and drag rope pay-out and take-up means while avoiding a tightline operating condition for the dragline type equipment during continued operation of the equipment.

2. An anti-tightline control system according to claim 1 further including a second summing circuit means serving to algebraically sum together the hoist rope and drag rope length signals, and a differentiating circuit means responsive to the output from said second summing circuit means for deriving a net hoist rope and drag rope velocity signal whose magnitude is representative of the net speed at which the hoist and drag rope means are being paid-out or taken-up and whose polarity is indicative of whether the hoist and drag rope means are being paid-out or taken-up, and means for supplying the output from said differentiating circuit means to an input for said first summing circuit means whereby said first summing circuit means sums the net hoist rope and drag rope velocity signal together with the hoist rope and drag rope position signals and the hoist and drag rope length allowed-in bias signal to derive an output dynamic hoist and drag rope speed-adjusted, allowed hoist and drag rope length anti-tightline boundary limited control signal useable in controlling operation of the dragline type equipment.

3. An anti-tightline control system according to claim 1 or 2 further including clamping circuit means coupled to said first summing circuit means for clamping the output anti-tightline boundary limited control signal to a range of values extending between an allowed first value corresponding to full speed operation of the dragline equipment and an allowed second value corresponding to shut-down of the equipment.

4. An anti-tightline control system according to claim 2 further including limit circuit means responsive to the output from said summing circuit means for establishing predetermined alarm and shut-down values for said allowed hoist and drag rope length anti-tightline boundary limited control signal, warning signal means responsive to the output from said limit circuit means for providing a warning to an operator of the dragline type equipment in the event the equipment approaches a tightline operating condition and the output signal from said summing circuit means exceeds the predetermined alarm value, and trip-out circuit means responsive to the output from said limit circuit means for controlling operation of the regulating control means for the respective hoist rope and drag rope means and automatically shutting-down operation of the respective hoist 5. An anti-tightline control system according to claim 2 further including limit circuit means responsive to the output from said summing circuit means for establishing predetermined alarm and shut-down values for said allowed hoist and drag rope length anti-tightline boundary limited control signal, warning signal means responsive to the output from said limit circuit means for providing a warning to an operator of the dragline type equipment in the event the equipment approaches a tightline operating condition and the output signal from said summing circuit means exceeds the predetermined alarm value, and trip-out circuit means responsive to the output from said limit circuit means for controlling operation of the regulating control means for the respective hoist rope and drag rope means and automatically shutting-down operation of the respective hoist rope and drag rope pay-out and take-up means in the event the output signal from the summing circuit means exceeds the shut-down value established by the limit circuit means, and further including clamping circuit means coupled to said summing circuit means for clamping the output anti-tightline boundary limited control signal to a range of values extending between an allowed first value corresponding to full speed operation of the dragline equipment and an allowed second value corresponding to shut-down of the equipment.

6. An anti-tightline control system according to claim 1 further including hoist rope length and drag rope length limit circuit means responsive to the respective outputs from said hoist rope and drag rope position encoding means, warning signal circuit means responsive to the output from said hoist rope and drag rope length limit circuit means for warning an operator of the drag-line type equipment that the allowed amount of hoist rope and drag rope taken-up is about to be exceeded, and trip-out circuit means responsive to the output from said hoist rope and drag rope length limit circuit means for automatically shutting-down operation of the respective hoist rope and drag rope pay-out and take-up means in the event the output signal from the summing circuit means exceeds the shut-down value established by the limit circuit means.

7. An anti-tightline control system according to claim 5 further including hoist rope length and drag rope length limit circuit means responsive to the respective outputs from said hoist rope and drag rope position encoding means, warning signal circuit means responsive to the output from said hoist rope and drag rope length limit circuit means for warning an operator of the dragline type equipment that the allowed amount of hoist rope or drag rope taken-up is about to be exceeded, and trip-out circuit means responsive to the output from said hoist rope and drag rope length limit circuit means for automatically shutting-down operation of the respective hoist rope and/or drag rope pay-out and take-up means in the event that the allowed amount of hoist rope or drag rope taken-up is exceeded by a predetermined value.

8. An anti-tightline control system according to claim 1 or 2 further including circuit means for converting the form of the anti-tightline boundary limited control signal from the summing circuit means to a different form compatible with the form of control signal required by a particular operator controlled hoist and drag rope regulating control means of a given dragline type equipment.

9. An anti-tightline control system according to claim 7 further including circuit means for converting the form of the anti-tightline boundary limited control signal from the summing circuit means to a different form compatible with the form of control signal required by a particular operator controlled hoist and drag rope regulating control means of a given dragline type equipment.

10. An anti-tightline control system according to claim 1 or 2 or 9 further including function generator means having a transfer function for separately defining a static tightline operating limit condition for specialized dragline type equipment whose static tightline boundary operation condition characteristics are non-elliptical in nature, said function generator means having its input supplied with the hoist rope position signal from said hoist rope position encoding means and deriving therefrom an output drag rope-in prohibited signal representative of the drag rope length required to be paid-out to avoid a static tightline operating condition, the output signal from said function generator means being supplied to the input of said summing circuit means in place of the hoist rope position signal for summation with said drag rope position signal, said hoist rope and drag rope velocity signal and the maximum hoist and drag rope-in allowed bias signal to derive an output dynamic hoist and drag rope speed adjusted allowed hoist and drag rope length anti-tightline boundary limited control signal for use with such specialized dragline type equipment.

11. In a drive regulating system for controlling operation of the bucket means for dragline type equipment having respective hoist and drag rope means attached to the bucket means which can be taken-up or paid-out by respective hoist rope and drag rope pay-out and take-up means to control the positioning and operation of the bucket means, and respective operator controlled hoist and drag rope regulating control means for controlling operation of said respective hoist rope and drag rope pay-out and take-up means; the improvement comprising anti-tightline control system means for monitoring the respective lengths of the hoist and drag rope means paid-out or taken-up at any given time and the speed at which the hoist and drag rope means is being taken-up and for deriving a rope speed adjusted allowed combined hoist and drag rope length anti-tightline boundary limited control signal, and means for supplying said anti-tightline boundary limited control signal to said respective operator controlled hoist and drag rope regulating control means for overriding the operator control settings and maintaining operation of said dragline type equipment within constraints required to avoid a tightline operating condition.

12. A drive regulating system for dragline type equipment according to claim 11 wherein said anti-tightline control system means comprises hoist rope position encoding means for deriving electric hoist rope position signals representative of the length of hoist rope means paid-out or taken-up by said hoist rope pay-out and take-up means at any given time, drag rope position encoding means for deriving electric drag rope position signals representative of the length of drag rope means paid-out or taken-up by said drag rope pay-out and take-up means at any given time, means for separately developing a maximum hoist and drag rope length allowed-in bias signal representative of the maximum length of hoist and drag rope allowed to be taken-up and still avoid a tightline condition if the hoist and drag rope velocities are near zero, summing circuit means responsive to the outputs from said hoist rope and drag rope position encoding means and said maximum hoist and drag rope-in allowed bias signal, said summing circuit means serving to sum together the hoist rope and drag rope positions signals with the maximum hoist and drag rope length allowed-in bias signal and to derive an output difference allowed hoist and drag rope length static anti-tightline boundary limited control signal that can be used in regulating and controlling operation of the hoist rope and drag rope pay-out and take-up means while avoiding a tightline operating condition for the dragline type equipment during continued operation of the equipment.

13. A drive regulating system for dragline type equipment according to claim 12 further comprising differentiating circuit means responsive to the outputs from said hoist rope and drag rope position encoding means for deriving a net hoist rope and drag rope velocity signal whose magnitude is representative of the net speed at which the hoist and drag rope means are being paid-out or taken-up and whose polarity is indicative of whether the sum of the hoist and drag rope means results in a net pay-out or take-up of the combined rope lengths, and means for supplying the output from said differentiating circuit means to an input for said summing circuit means whereby said summing circuit means sums the hoist rope and drag rope velocity together with the hoist rope and drag rope position signals and the hoist and drag rope length allowed-in bias signal to derive an output dynamic hoist and drag rope speed adjusted allowed hoist and drag rope length anti-tightline boundary limited control signal useable in controlling operation of dragline type equipment.

14. A drive regulating system for dragline type equipment according to claim 13 further including limit circuit means responsive to the output from said summing circuit means for establishing predetermined alarm and shut-down values for said allowed hoist plus drag rope length anti-tightline boundary limited control signal, warning signal means responsive to the output from said limit circuit means for providing a warning to an operator of the dragline type equipment in the event the equipment approaches a tightline operating condition and the output signal from said summing circuit means exceeds the predetermined alarm value, and trip-out circuit means responsive to the output from said limit circuit means for controlling operation of the regulating control means for the respective hoist rope and drag rope means and automatically shutting-down operation of the respective hoist rope and drag rope pay-out and take-up means in the event the output signal from the summing circuit means exceeds the shut-down value established by the limit circuit means.

15. A drive regulating system for dragline type equipment according to claim 14 further including hoist rope length and drag rope length limit circuit means responsive to the respective outputs from said hoist rope and drag rope position encoding means, warning signal circuit means responsive to the output from said hoist rope and drag rope length limit circuit means for warning an operator of the dragline type equipment that the allowed amount of hoist rope or drag rope taken-up is about to be exceeded, and trip-out circuit means responsive to the output from said hoist rope and drag rope length limit circuit means for automatically shutting-down operation of the respective hoist rope and drag rope pay-out and take-up means in the event that the allowed amount of hoist rope or drag rope taken-up is exceeded by a predetermined value.

16. A drive regulating system for dragline type equipment according to claim 11, 12 or 15 further including function generator means having a transfer function for separately defining a static tightline operating limit condition for specialized dragline type equipment whose static tightline boundary operation condition characteristics are non-elliptical in nature, said function generator means having its input supplied with the hoist rope postion signal from said hoist rope position encoding means and deriving therefrom an output drag rope-in prohibited signal representative of the drag rope length required to be paid-out to avoid a static tightline operating condition, the output signal from said function generator means being supplied to the input of said summing circuit means in place of the hoist rope position signal for summation with said drag rope position signal, said hoist rope and drag rope velocity signal and the maximum hoist and drag rope-in allowed bias signal to derive an output dynamic hoist and drag rope speed adjusted allowed hoist and drag rope length anti-tightline boundary limited control signal for use with such specialized dragline type equipment.

17. A drive regulating system for dragline type equipment according to claim 15 further including circuit means for converting the form of the anti-tightline boundary limited control signal from the summing circuit means to a different form compatible with the form of control signal required by a particular operator controlled hoist and drag rope regulating control means of a given dragline type equipment.

18. A drive regulating system for dragline type equipment according to claim 16 further including circuit means for converting the form of the anti-tightline boundary limited control signal from the summing circuit means to a different form compatible with the form of control signal required by a particular operator controlled hoist and drag rope regulating control means of a given dragline type equipment.

19. A drive regulating system for dragline type equipment according to either claim 11 or 12 further including clamping circuit means coupled to said summing circuit means for clamping the output anti-tightline boundary limited control signal to a range of values extending between an allowed first value corresponding to full speed operation of the dragline equipment and an allowed second value corresponding to shut-down of the equipment.

20. A motion drive regulating system from dragline type equipment according to claim 17 further including clamping circuit means coupled to said summing circuit means for clamping the output anti-tightline boundary limited control signal to a range of values extending between an allowed first value corresponding to full speed operation of the dragline equipment and an allowed second value corresponding to shut-down of the equipment.

21. In a drive regulating system for dragline type equipment having respective hoist and drag ropes which can be taken-up or paid-out by an operator to control the positioning and operation of a bucket for doing work and which can be so operated as to place the dragline type equipment in a tightline condition that in turn could result in damaging the equipment; the method of controlling operation of the drive regulating system by deriving an anti-tightline control regulating signal for overriding the operator control setting under threatened tightline operating conditions and for regulating further take-up of the hoist and drag ropes so as to avoid a tightline operating condition while maintaining continued operation of the dragline type equipment, said method comprising deriving respective hoist rope and drag rope position electric signals which are indicative of the length of hoist and drag rope paid-out or taken-up at any given instant of time, separately developing a maximum hoist and drag rope length allowed-in bias signal representative of the maximum length of hoist and drag rope allowed to be taken-up and still avoid a tightline condition if the rope velocities are near zero, comparing the combined hoist and drag position electric signals with the maximum hoist and drag rope length allowed-in bias signal and deriving an output difference allowed hoist and drag rope length static anti-tightline boundary limited control signal that can be used for regulating and controlling further operation of the dragline type equipment while avoiding a tightline operating condition during continued operation of the equipment.

22. The method of controlling operation of the drive regulating system of dragline type equipment according to claim 21 further comprising differentiating the hoist rope and drag rope position signals for deriving hoist and drag rope net velocity signal whose magnitude is representative of the net speed at which the hoist and drag ropes are being paid-out or taken-up and whose polarity is indicative of whether the hoist and drag ropes are in sum being taken-up or paid-out, and adding said hoist and drag rope net velocity signal into the comparison of the hoist and drag rope position signals to the maximum hoist and drag rope length allowed-in bias signal whereby in effect the absolute value of the rope allowed-in bias signal is dynamically varied in accordance with the rope net speed and the output difference allowed hoist and drag rope length anti-tightline boundary limited control signal is dynamically varied in a direction to decrease the value of the maximum rope length allowed-in for increasing rope take-up speeds.

23. The method of controlling operation of the drive regulating system of dragline type equipment according to claim 21 for dragline type equipment having a specialized static tightline boundary operating condition characteristic which is non-elliptical in nature; said method further comprising processing the hoist rope position electric signal in a suitable function generator whose transfer function corresponds to the specialized static tightline boundary operating condition characteristic of the dragline type equipment and deriving at its output a drag rope-in prohibited signal for use in place of the hoist rope position signal otherwise used in the comparison step to derive the output difference allowed hoist and drag rope length static anti-tightline boundary limited control signal for regulating and controlling continued operation of the dragline type equipment.

24. The method of controlling operation of the drive regulating system of dragline type equipment according to claim 22 for dragline type equipment having a specialized static tightline boundary operating condition characteristic which is non-elliptical in nature; said method further comprising processing the hoist rope position electric signal in a suitable function generator whose transfer function corresponds to the specialized static tightline boundary operating condition characteristic of the dragline type equipment and deriving at its output a drag rope-in prohibited signal for use in place of the hoist rope position signal otherwise used in the comparison step to derive the output difference allowed hoist and drag rope length static anti-tightline boundary limited control signal for regulating and controlling continued operation of the dragline type equipment.

25. The method of controlling operation of the drive regulating system of dragline type equipment according to claims 21, 23 or 24 further comprising clamping the output anti-tightline boundary limited control signal to a range of values extending between an allowed first value corresponding to full speed operation of the dragline equipment and an allowed second value corresponding to shut-down of the equipment.

26. The method of controlling operation of the drive regulating system of dragline type equipment according to claim 21, 22, 23, or 24 further comprising deriving a warning signal to an operator of the dragline type equipment in the event the value of the output anti-tightline boundary limited control signal exceeds a predetermined first limit value indicative that the dragline type equipment is approaching a tightline operating condition, and deriving a shut-down signal that trips-out or otherwise stops further operation of the dragline type equipment in the take-up direction in the event that the anti-tightline boundary limited control signal exceeds the first limit value by a predetermined amount.

27. The method of controlling operation of the drive regulating system of dragline type equipment according to claim 21, 22, 23 or 24 further comprising deriving a warning signal to an operator of the dragline type equipment in the event the value of the combined hoist rope and drag rope position signals indicate that the amount of hoist or drag rope taken-up exceeds a first limit value smaller by a predetermined amount than the maximum length of hoist and drag rope allowed to be taken-up and still avoid a tightline condition if the rope velocities are near zero, and deriving a shut-down signal that trips-out or otherwise stops further operation of the dragline type equipment in the take-up direction in the event that the amount of hoist or drag rope taken-up exceeds the first limit value by a predetermined amount.

28. The method of controlling operation of the drive regulating system of dragline type equipment according to claim 21, 22, 23 or 24 further comprising converting the form of the anti-tightline boundary limited control signal to a different form compatible with the form of control regulating signal required by a particular operator controlled hoist and drag rope drive regulating means of a given dragline type equipment.

29. The method of controlling operation of the drive regulating system of dragline type equipment according to claim 22 further comprising clamping the output anti-tightline boundary limited control signal to a range of values extending between an allowed first value corresponding to full speed operation of the dragline equipment and an allowed second value corresponding to shut-down of the equipment.

30. The method of controlling operation of the drive regulating system of dragline type equipment according to claim 29 further comprising deriving a warning signal to an operator of the dragline type equipment in the event the value of the output anti-tightline boundary limited control signal exceeds a predetermined first limit value indicative that the dragline type equipment is approaching a tightline operating condition, and deriving a shut-down signal that trips-out or otherwise stops further operation of the dragline type equipment in the take-up direction in the event that the anti-tightline boundary limited control signal exceeds the first limit value by a predetermined amount.

31. The method of controlling operation of the drive regulating system of dragline type equipment according to claim 30 further comprising deriving a warning signal to an operator of the dragline type equipment in the event the value of the combined hoist rope and drag rope position signals indicate that the amount of hoist or drag rope taken-up exceeds a first limit value smaller by a predetermined amount than the maximum length of hoist and drag rope allowed to be taken-up and still avoid a tightline condition if the rope velocities are near zero, and deriving a shut-down signal that trips-out or otherwise stops further operation of the dragline type equipment in the take-up direction in the event that the amount of hoist or drag rope taken-up exceeds the first limit value by a predetermined amount.

32. The method of controlling operation of the drive regulating system of dragline type equipment according to claim 31 further comprising converging the form of the anti-tightline boundary limited control signal to a different form compatible with the form of control regulating signal required by a particular operator controlled hoist and drag rope drive regulating means of a given dragline type equipment.

33. The method of controlling operation of the drive regulating system of dragline type equipment according to claim 32 for dragline type equipment having a specialized static tightline boundary operating condition characteristic which is non-elliptical in nature; said method further comprising processing the hoist rope position electric signal in a suitable function generator whose transfer function corresponds to the specialized static tightline boundary operating condition characteristic of the dragline type equipment and deriving at its output a drag rope-in prohibited signal for use in place of the hoist rope position signal otherwise used in the comparison step to derive the output difference allowed hoist and drag rope length static anti-tightline boundary limited control signal for regulating and controlling continued operation of the dragline type equipment.

* * * * *